US008841572B2

(12) United States Patent
Iwamoto et al.

(10) Patent No.: US 8,841,572 B2
(45) Date of Patent: Sep. 23, 2014

(54) SWITCH DEVICE AND CONNECTOR

(75) Inventors: Daiei Iwamoto, Tokyo (JP); Takashi Yuba, Tokyo (JP); Koichi Kiryu, Nagano (JP); SeungSeok Beak, Tokyo (JP); Akio Nakamura, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 286 days.

(21) Appl. No.: 13/541,889

(22) Filed: Jul. 5, 2012

(65) Prior Publication Data

US 2013/0037518 A1 Feb. 14, 2013

(30) Foreign Application Priority Data

Aug. 11, 2011 (JP) ..... 2011-176404

(51) Int. Cl.

| | |
|---|---|
| ***H01H 33/16*** | (2006.01) |
| ***H01H 9/44*** | (2006.01) |
| ***H01H 1/26*** | (2006.01) |
| *H01H 15/10* | (2006.01) |
| *H01H 15/24* | (2006.01) |
| *H01H 13/52* | (2006.01) |

(52) U.S. Cl.

CPC ..... *H01H 1/26* (2013.01); *H01H 15/102* (2013.01); *H01H 9/443* (2013.01); *H01H 15/24* (2013.01); *H01H 13/52* (2013.01)

USPC ..... 218/26; 200/430; 335/154

(58) Field of Classification Search

USPC ..... 200/430; 218/23–26; 335/154

See application file for complete search history.

(56) References Cited

U.S. PATENT DOCUMENTS

| | | | | |
|---|---|---|---|---|
| 3,604,875 | A * | 9/1971 | Walters et al. | 200/430 |
| 5,519,370 | A * | 5/1996 | Perreira et al. | 335/154 |
| 6,792,225 | B2 * | 9/2004 | Sugano et al. | 399/88 |
| 2009/0114622 | A1 * | 5/2009 | Bush et al. | 218/23 |
| 2012/0145674 | A1 * | 6/2012 | Schellekens et al. | 218/122 |
| 2013/0301181 | A1 * | 11/2013 | Naka et al. | 361/194 |

FOREIGN PATENT DOCUMENTS

| | | |
|---|---|---|
| CN | 101297384 | 10/2008 |
| CN | 102064430 | 5/2011 |
| GB | 979464 | 1/1965 |
| JP | 05-082208 | 4/1993 |
| JP | 2002-367470 | 12/2002 |
| JP | 2003-031301 | 1/2003 |

* cited by examiner

*Primary Examiner* — Truc Nguyen
(74) *Attorney, Agent, or Firm* — IPUSA, PLLC

(57) ABSTRACT

A switch device includes first and second contacting portions including first and second fixed contacting portions and first and second movable contacting portions configured to contact the first and second fixed contacting portions, respectively and provided to be adjacent from each other; and a magnet unit provided such that a first pole is positioned to face the first contacting portion and a second pole is positioned to face the second contacting portion to generate magnetic fields between the first fixed contacting portion and the first movable contacting portion and between the second fixed contacting portion and the second movable contacting portion, respectively.

11 Claims, 20 Drawing Sheets

SWITCH DEVICE AND CONNECTOR

BACKGROUND OF THE INVENTION

1. Field of the Invention

The present invention relates to a switch device and a connector.

2. Description of the Related Art

Generally, an electrical or electronic device is driven by supplying electric power from a power source of the like. When supplying the electric power from the power source or the like, the electric power is supplied to the electrical or electronic device through connectors. The connectors for connecting the electrical or electronic device and the power source may be a combination of a jack type connector and a plug type connector configured to be fitted in the jack type connector, as described in Patent Documents 1, Patent Documents 2 and the like.

Recently, as a countermeasure for global warming or the like, supplying of electric power of a direct current with a high voltage has been considered even for the power transmission in a local area. By using the electric power of a direct current with a high voltage, the power loss at the conversion of the voltage, the power transmission or the like can be reduced and it is not necessary to use a heavy cable. Especially, as an information device such as a server or the like consumes a large amount of electric power, supplying of the electric power of a direct current with a high voltage is desirable for the information device.

However, if the voltage of the electric power supplied to the electrical or electronic device is high, the electric power may cause some effects on a human body, or some effects on an operation of electronic components.

When such electric power of a direct current with a high voltage is used for an information device such as a server or the like, it is necessary to provide connectors which are different from connectors used for a general-purpose commercial power source of an alternating current. Further, as the connectors may be handled by a human when installing or maintaining the device, it is necessary to care for the effects on the human body or the like as well.

Further, if the electric power supplied from the power source exceeds 100 V or is direct current with a high voltage, when a switch device is incorporated in a connector, a current commercially available switch cannot be used as it is. For example, when the electric power supplied from the power source is direct current with 400 V, it may not be safe to use a switch device, which is currently used for electric power of an alternating current with 100 V as safety and reliability are not ensured.

PATENT DOCUMENT

[Patent Document 1] Japanese Laid-open Patent Publication No. H05-82208

[Patent Document 2] Japanese Laid-open Patent Publication No. 2003-31301

SUMMARY OF THE INVENTION

According to an embodiment, there is provided a switch device including a first contacting portion including a first fixed contacting portion and a first movable contacting portion configured to contact the first fixed contacting portion; a second contacting portion including a second fixed contacting portion and a second movable contacting portion configured to contact the second fixed contacting portion, and provided to be adjacent to the first contacting portion, the first contacting portion and the second contacting portion being configured to be electrically connected to a power source such that directions of currents flowing through the first contacting portion and the second contacting portion at the first contacting area and the second contacting area are the same; and a magnet unit provided such that a first pole is positioned to face a first contacting area of the first fixed contacting portion and the first movable contacting portion to generate a magnetic field between the first fixed contacting portion and the first movable contacting portion, and a second pole, opposite to the first pole, is positioned to face a second contacting area of the second fixed contacting portion and the second movable contacting portion to generate a magnetic field between the second fixed contacting portion and the second movable contacting portion.

According to another embodiment, there is provided a connector for electrically connecting a power source and an electronic device, including a switch device that includes, a switch device that includes, a first contacting portion including a first fixed contacting portion and a first movable contacting portion configured to contact the first fixed contacting portion, a second contacting portion including a second fixed contacting portion and a second movable contacting portion configured to contact the second fixed contacting portion, and provided to be adjacent to the first contacting portion, the first contacting portion and the second contacting portion being configured to be electrically connected to a power source such that directions of currents flowing through the first contacting portion and the second contacting portion at the first contacting area and the second contacting area are the same, and a magnet unit provided such that a first pole is positioned to face a first contacting area of the first fixed contacting portion and the first movable contacting portion to generate a magnetic field between the first fixed contacting portion and the first movable contacting portion, and a second pole, opposite to the first pole, is positioned to face a second contacting area of the second fixed contacting portion and the second movable contacting portion to generate a magnetic field between the second fixed contacting portion and the second movable contacting portion; and a first fitting terminal and a second fitting terminal configured to be electrically connected to the first fixed contacting portion and the second movable contacting portion, or the first movable contacting portion and the second fixed contacting portion, respectively, to be fitted with terminals of another connector.

Note also that arbitrary combinations of the above-described constituents, and any exchanges of expressions in the present invention, made among method, device, system, and so forth, are valid as embodiments of the present invention.

BRIEF DESCRIPTION OF THE DRAWINGS

Other objects, features and advantages of the present invention will become more apparent from the following detailed description when read in conjunction with the accompanying drawings.

DETAILED DESCRIPTION OF THE PREFERRED EMBODIMENTS

Figure 1:
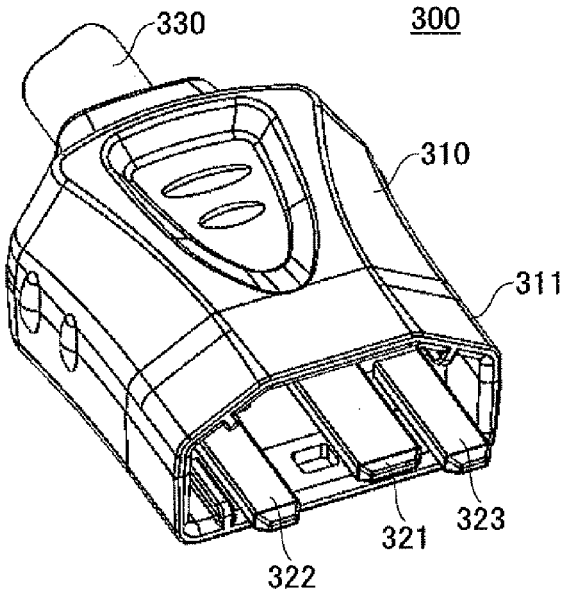
FIG. 1 is a perspective view of an example of a plug connector.

The invention will be described herein with reference to illustrative embodiments. Those skilled in the art will recognize that many alternative embodiments can be accomplished using the teachings of the present invention and that the invention is not limited to the embodiments illustrated for explanatory purposes.

It is to be noted that, in the explanation of the drawings, the same components are given the same reference numerals, and explanations are not repeated.

A switch device and a connector of embodiments are configured to correspond to a high voltage. However, in the following embodiments, the expression "high voltage" does not mean a "direct current of over 750 V" which is defined by the electrical equipment technical standards or a "direct current of higher than or equal to 1500 V" which is an international standard defined by the International Electrotechnical Commission (TEC). Instead, the expression "high voltage" means a voltage that exceeds a safety extra low voltage (a direct current of less than 60 V). In other words, the "high voltage" in the following embodiments means a voltage higher than or equal to 60 V.

First Embodiment

Structure of Connector

The structure of a connector of a first embodiment is explained.

Figure 4:
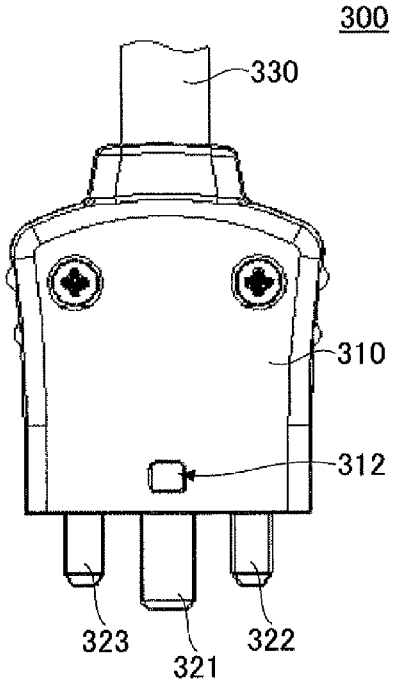
FIG. 4 is a bottom view of an example of the plug connector.
Figure 5:
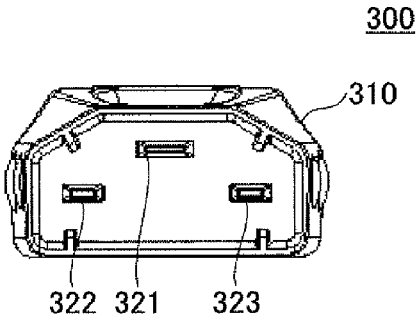
FIG. 5 is an elevation view of an example of the plug connector.
Figure 6:
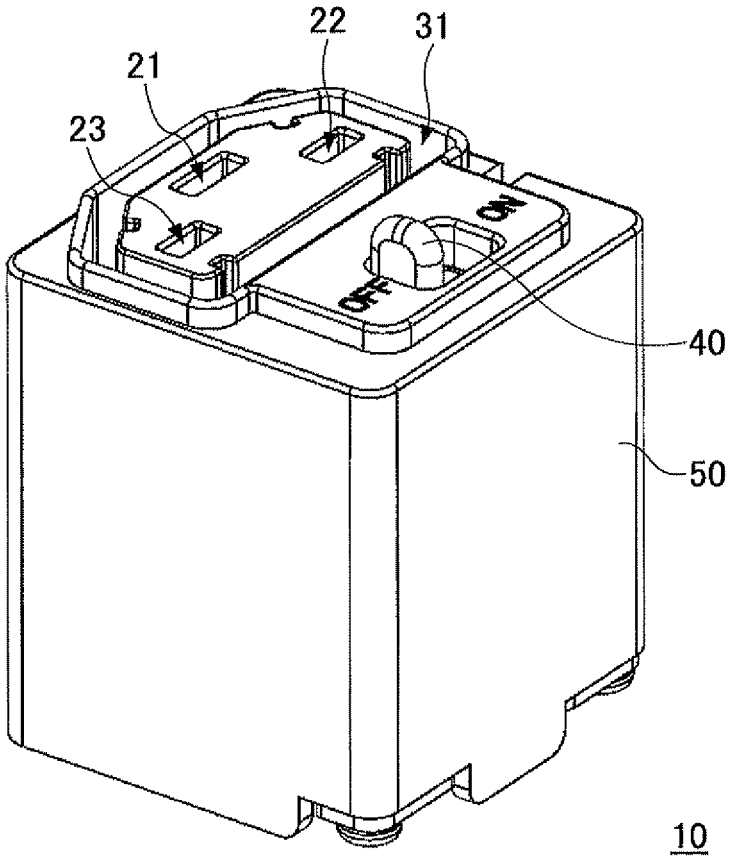
FIG. 6 is a perspective view of an example of a jack connector of a first embodiment.
Figure 7:
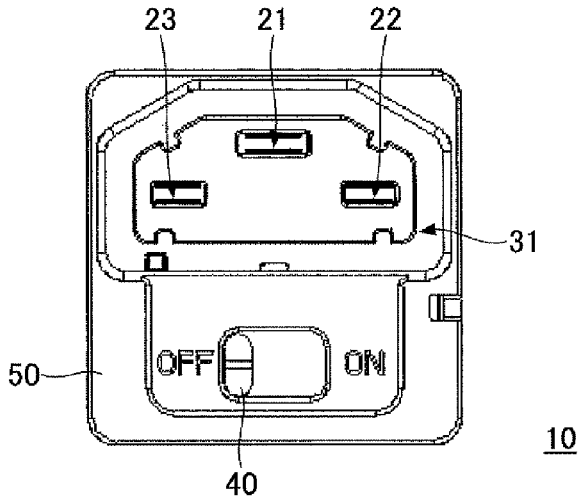
FIG. 7 is an elevation view of an example of the jack connector of the first embodiment.
Figure 8:
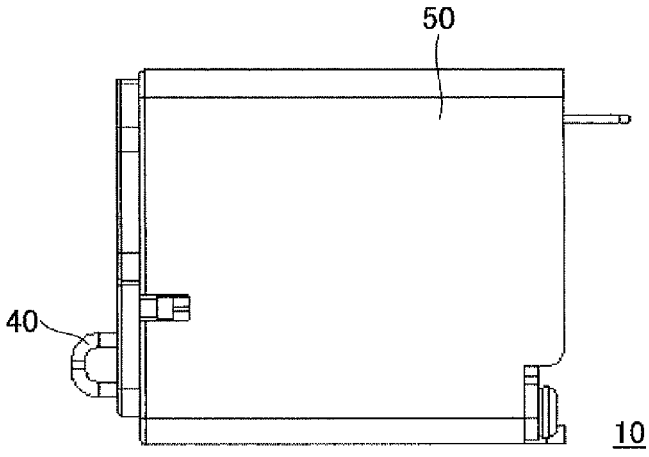
FIG. 8 is a side view of an example of the jack connector of the first embodiment.

The connector of the embodiment is a jack connector 10 shown in FIG. 6 to FIG. 8 which is to be connected to a plug connector 300 (which is an example of another connector) shown in FIG. 1 to FIG. 5. Hereinafter, a connected structure of the plug connector 300 and the jack connector 10 is referred to as a connector as well.

First, the structure of the plug connector 300 is explained with reference to FIG. 1 to FIG. 5.

Figure 2:
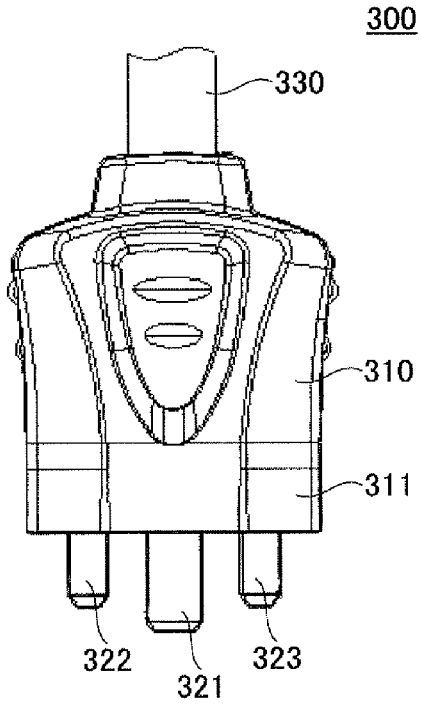
FIG. 2 is a top view of an example of the plug connector.
Figure 3:
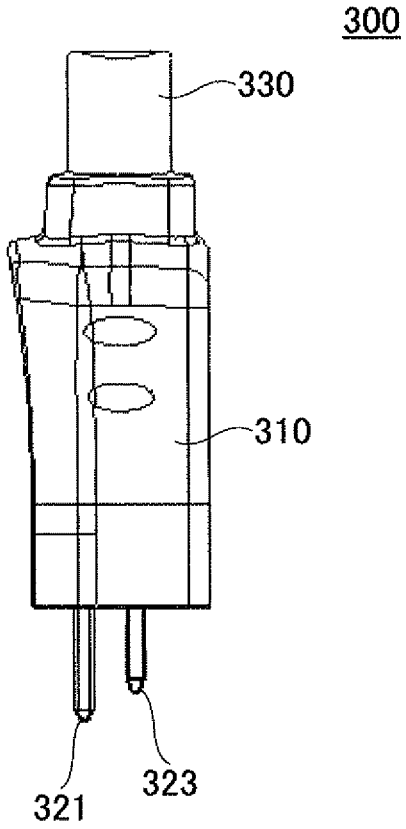
FIG. 3 is a side view of an example of the plug connector.

FIG. 1 is a perspective view of the plug connector 300, FIG. 2 is a top view of the plug connector 300, FIG. 3 is a side view of the plug connector 300, FIG. 4 is a bottom view of the plug connector 300, and FIG. 5 is an elevation view of the plug connector 300.

The plug connector 300 includes a cover 310, three plug terminals 321, 322 and 323, and a cable 330. Further, the cover 310 of the plug connector 300 is provided with a protection portion 311 and an opening 312 (see FIG. 4).

The cover 310 is made of an insulator or the like, for example. The plug terminals 321, 322 and 323 are provided at one side of the cover 310. The plug terminal 321 is a GND terminal and formed to be longer than the plug terminals 322 and 323. The plug terminals 322 and 323 (an example of terminals of the other connector) are configured to be electrically connected to terminals of the jack connector 10 so that electric power is supplied, as will be explained later.

The protection portion 311 is provided at the one side of the cover 310 to surround a part of the plug terminals 321, 322 and 323. The cable 330 is connected to the cover 310 at the other side of the cover 310. In this embodiment, the plug connector 300 is configured to be electrically connected to an electric device via the cable 330. The opening 312 is provided to fix the plug connector 300 with the jack connector 10 when the plug connector 300 is connected to the jack connector 10.

Next, the structure of the jack connector 10 of the embodiment is explained with reference to FIG. 6 to FIG. 8.

FIG. 6 is a perspective view of the jack connector 10, FIG. 7 is an elevation view of the jack connector 10 and FIG. 8 is a side view of the jack connector 10.

The jack connector 10 includes a housing 50 and an operation unit 40. Further, the jack connector 10 is provided with jack openings 21, 22 and 23 to which the plug terminals 321, 322 and 323 of the plug connector 300 are to be inserted, respectively, and a groove portion 31 to which the protection portion 311 of the plug connector 300 is to be inserted. The housing 50 covers the entirety of the jack connector 10. The jack openings 22 and 23 are an example of a first fitting terminal and a second fitting terminal. In this embodiment, as will be explained later, the jack connector 10 is configured to be electrically connected to a power source.

The operation unit 40 is provided to operate a switch device, which will be explained later, for controlling whether to supply electric power from the power source when the plug connector 300 and jack connector 10 are physically connected. The operation unit 40 is slidable between an "ON" position and an "OFF" position. By sliding the operation unit 40, the switch device is operated and whether to supply the electric power from the power source via the jack connector 10 to the plug connector 300 is controlled.

Figure 9:
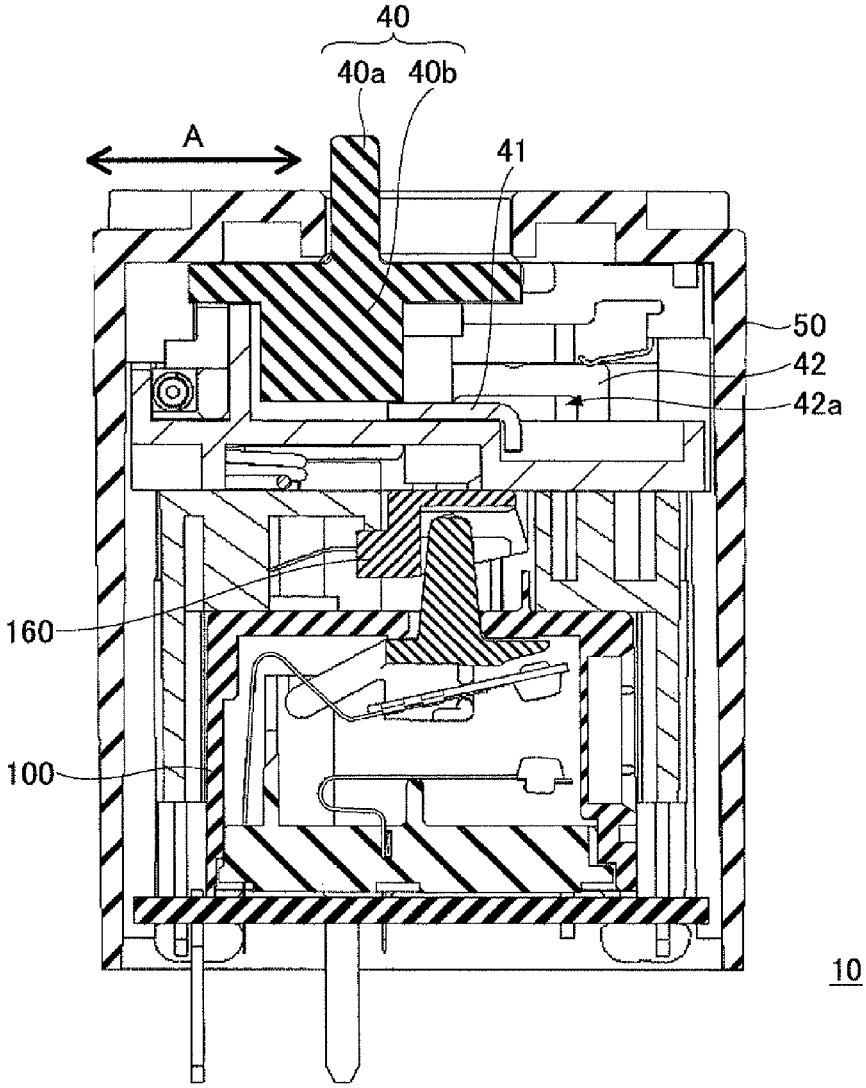
FIG. 9 is a cross-sectional view showing an example of the internal structure of the jack connector of the first embodiment.

The internal structure of the jack connector 10 of the embodiment is explained in detail with reference to FIG. 9. FIG. 9 is a cross-sectional view showing an example of the internal structure of the jack connector 10.

The jack connector 10 further includes a link portion 41, a contact slide portion 42, and a switch device 100.

The switch device 100 includes a button 160 that functions to switch on and off the electrical connection between the jack connector 10 and the plug connector 300, as will be explained later.

The operation unit 40 includes a sliding body portion **40*b* and an operational protruding portion 40*a* which is provided at an upper portion of the sliding body portion 40***b*. The operational protruding portion 40*a* protrudes outside the housing 50 from an opening provided at a top of the housing 50.

The jack connector 10 is configured such that when the operational protruding portion 40*a* of the operation unit 40 is moved in a direction shown by an arrow "A" (which will be referred to as a sliding direction), the switch device 100 is also operated to switch on and off the electrical connection between the jack connector 10 and the plug connector 300 (in other words, the electrical connection between the electric device and the power source).

The sliding body portion 40*b* is housed in the housing 50 and is connected to the link portion 41.

The contact slide portion 42 is provided with a slide opening 42*a* and a protruding contacting portion (not shown in the drawings). The protruding contacting portion is formed to extend in a direction (downward direction in FIG. 9) substantially perpendicular to the sliding direction. The protruding contacting portion of the contact slide portion 42 is provided to contact a top of the button 160 of the switch device 100 when the contact slide portion 42 is moved by the link portion 41.

The slide opening 42*a* is formed to extend in a direction substantially parallel to the sliding direction.

The link portion 41 is configured to be moved in a direction substantially parallel to the sliding direction. The link portion 41 is formed to have an "L" shape where one end of the "L" shape structure is inserted in the slide opening 42*a* of the contact slide portion 42 to be slidable within the slide opening 42*a* in the direction substantially perpendicular to the sliding direction.

The plug connector 300 and the jack connector 10 may be configured such that a hook (not shown in the drawings) of the jack connector 10 is fitted to the opening 312 of the plug connector 300 (see FIG. 4) when the operation unit 40 is operated to be positioned at the "ON" position and the electric power is supplied to the plug connector 300. Further, the plug connector 300 and the jack connector 10 may be configured such that the hook of the jack connector 10 is released from the opening 312 of the plug connector 300 when the operation unit 40 is operated to be positioned at the "OFF" position so that the plug connector 300 can be released from the jack connector 10. Further, the jack connector 10 may be configured such that the operation unit 40 cannot be moved to the "ON" position when the plug connector 300 is not physically connected to the jack connector 10, in other words, when the hook (not shown in the drawings) of the jack connector 10 is not fitted to the opening 312 of the plug connector 300.

Switch Device

The structure of the switch device 100 is now explained. The switch device 100 of the jack connector 10 functions to control supplying of the electric power from the power source. The switch device 100 may be referred to as a "power switch" as well.

Figure 10:
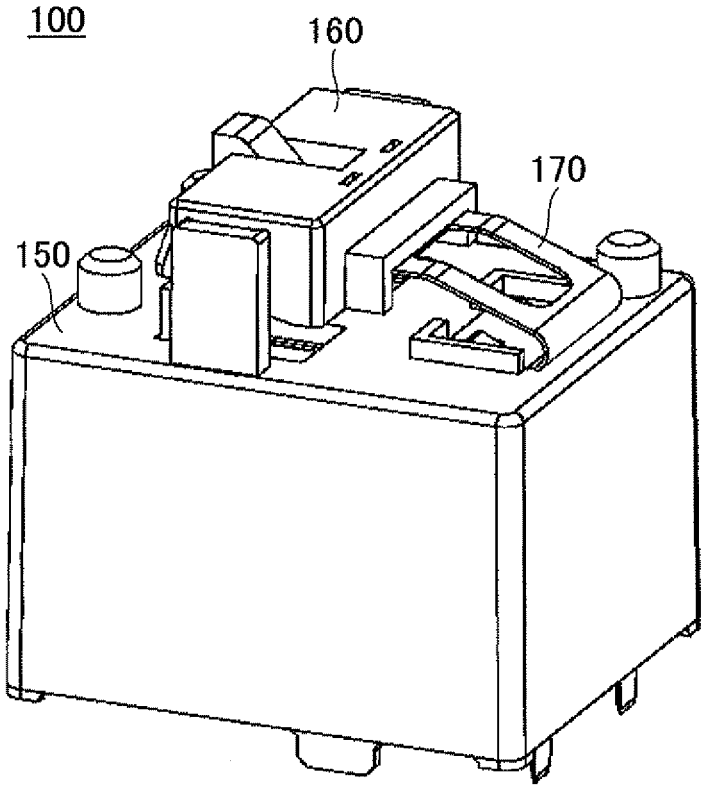
FIG. 10 is a perspective view of an example of a switch device of the first embodiment.
Figure 11:
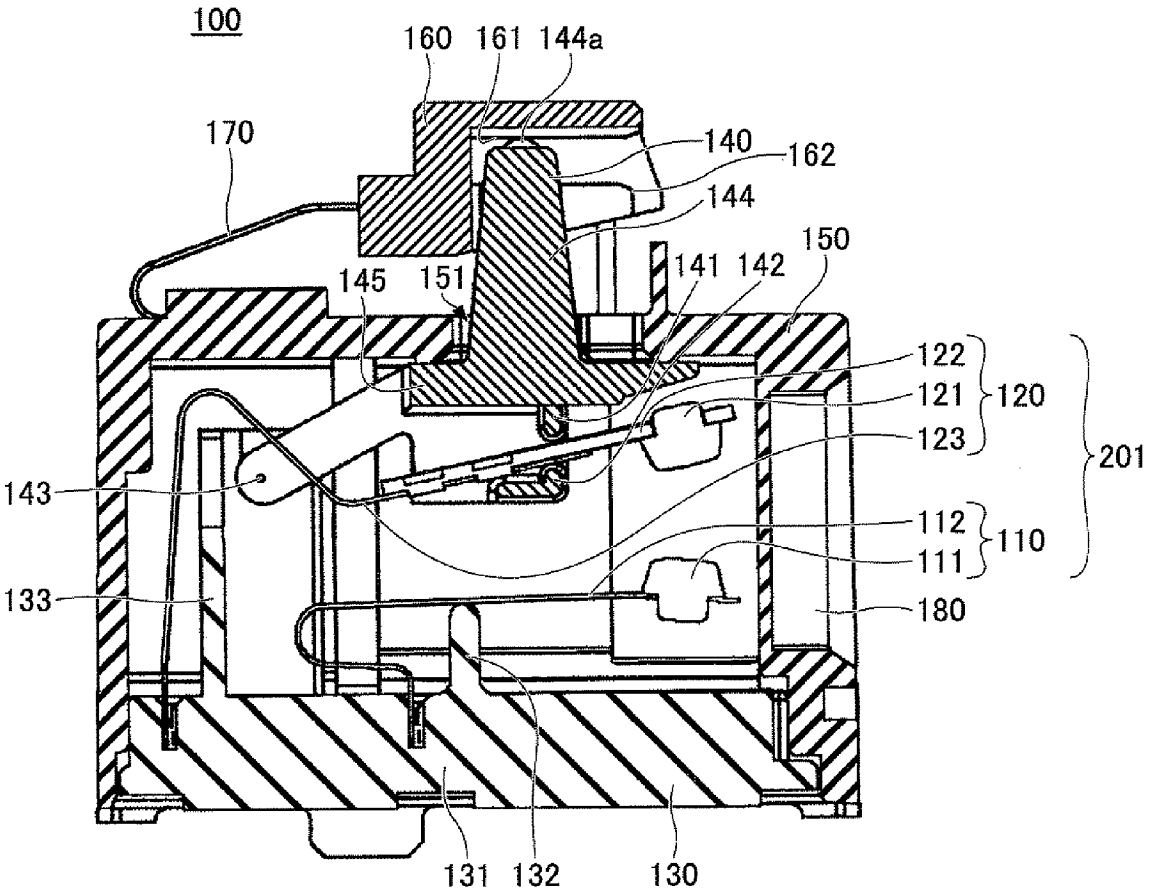
FIG. 11 is a cross-sectional view of an example of the switch device of the first embodiment.

FIG. 10 is a perspective view of an example of the switch device 100. FIG. 11 is a cross-sectional view of the switch device 100 showing an example of the internal structure of the switch device 100.

Referring to FIG. 11, the switch device 100 includes contacting portions 201 including fixed portions 110 and movable portions 120, a base block 130, a card member 140, a switch device housing 150, the button 160, a spring 170 and a magnet unit including permanent magnets 180.

As will be explained later, the switch device 100 of the embodiment includes two of the contacting portions 201 each including the fixed portion 110 (a first fixed portion 110*a* or a second fixed portion 110*b*) and the movable portion 120 (a first movable portion 120*a* or a second movable portion 120*b*), and the permanent magnets 180 (a first permanent magnet 180*a* and a second permanent magnet 180*b*), although only one of each of them is shown in FIG. 10 and FIG. 11 (see also FIG. 13, FIG. 14 and the like).

The base block 130 includes a base block body portion 131, a fixed portion support portion 132 and an insulating wall 133. The insulating wall 133 may be made of fire-retardant resin or the like, for example.

The fixed portions 110 are made entirely of an electrical conductive material such as a metal or the like. Each of the fixed portions 110 includes a fixed spring 112 and a fixed contacting portion 111 provided at one end of the fixed spring 112. The fixed spring 112 may be formed by bending a metal plate or the like made of copper, an alloy including copper or the like, for example. The fixed contacting portion 111 may be made of an alloy including silver and copper, for example. Another end of the fixed spring 112 is fixed at the base block body portion 131 of the base block 130 and the middle part of the fixed spring 112 is supported by the fixed portion support portion 132 of the base block 130.

Similar to the fixed portions 110, the movable portions 120 are made entirely of an electrical conductive material such as a metal or the like. Each of the fixed portions 110 includes a movable plate portion 122, a movable spring 123 and a movable contacting portion 121. The movable contacting portion 121 is provided at one end of the movable plate portion 122 to correspond to the fixed contacting portion 111 of the fixed portions 110 to be contacted. One end of the movable spring 123 is connected to another end of the movable plate portion 122. The movable plate portion 122 and the movable spring 123 may be formed by bending a metal plate or the like made of copper, an alloy including copper or the like, for example. The movable contacting portion 121 may be made of an alloy including silver and copper, for example. Another end of the movable spring 123 is fixed in the base block body portion 131 of the base block 130. As the movable spring 123 is formed by bending the metal plate or the like, for example, the movable spring 123 has flexibility. Thus, the movable contacting portion 121 provided at the one end of the movable plate portion 122 is capable of being moved in an upward and downward direction.

The insulating wall 133 of the base block 130 is provided between a portion where the other end of the fixed spring 112 is fixed and a portion where the other end of the movable spring 123 is fixed. Thus, the movable spring 123 is bent to pass over the insulating wall 133 of the base block 130.

The switch device housing 150 is provided with a switch device opening 151 formed at its upper surface.

The card member 140 includes an upper contacting portion 141, a lower contacting portion 142, a rotating shaft 143, a protruding portion 144, a body portion 145, and a contacting portion 144*a* provided at upper portion of the protruding portion 144.

The card member 140, the base block 130 and the switch device housing 150 may be made of an insulating material such as resin or the like, respectively.

The upper contacting portion 141 of the card member 140 is provided to contact one surface (upper surface in FIG. 11) of the movable plate portion 122 of the movable portion 120, and the lower contacting portion 142 of the card member 140 is provided to contact the other surface (lower surface in FIG. 11) of the movable plate portion 122 of the movable portion 120. In other words, the movable plate portion 122 of the movable portion 120 is sandwiched by the upper contacting portion 141 and the lower contacting portion 142 of the card member 140. Further, the upper contacting portion 141 and the lower contacting portion 142 of the card member 140 are provided to slide on the one surface and the other surface of the movable plate portion 122, respectively. Thus, in order to reduce frictional resistance, the upper contacting portion 141 and the lower contacting portion 142 may be provided with surface layers made of fluorocarbon resin or the like at the surfaces, respectively.

Under this state, when the card member 140 is rotated around the rotating shaft 143, the force is applied to the movable plate portion 122 via the upper contacting portion 141 or the lower contacting portion 142 of the card member 140 so that the movable contacting portion 121 is moved downward or upward, respectively.

The fixed portions 110 and the movable portions 120 are provided within an area surrounded by the base block 130 and the switch device housing 150. The protruding portion 144 of the card member 140 is provided to protrude outside of the switch device housing 150 from the switch device opening 151 of the switch device housing 150. The body portion 145, the upper contacting portion 141 and the lower contacting portion 142 of the card member 140 are provided within an area surrounded by the base block 130 and the switch device housing 150.

The button 160 is provided outside the switch device housing 150 to push the protruding portion 144 of the card member 140 for rotating the card member 140 around the rotating shaft 143. The contacting portion 144*a* of the card member 140 contacts an inner wall portion 161 of the button 160. The contacting portion 144*a* of the card member 140 is provided to slide on a surface of the inner wall portion 161. Thus, in order to reduce frictional resistance, the inner wall portion 161 may be provided with a surface layer made of fluorocarbon resin or the like at the surface.

The spring 170 is provided outside the switch device housing 150. One end of the spring 170 is connected to the switch device housing 150 and the other end of the spring 170 is connected to the button 160.

The switch device 100 is configured to supply the electric power to the plug connector 300 when the fixed contacting portions 111 of the fixed portions 110 and the movable contacting portions 121 of the movable portions 120 are in contact, respectively, and terminate supplying of the electric power to the plug connector 300 when the fixed contacting portions 111 of the fixed portions 110 and the movable contacting portions 121 of the movable portions 120 are not in contact, respectively.

ON and OFF Operation of Switch Device

It is assumed that the plug connector 300 and the jack connector 10 are physically connected at this time. Then, when the operation unit 40 is operated to be positioned at the "ON" position, the sliding body portion 40*b* is moved in the sliding direction shown by the arrow "A" (see FIG. 9). With the movement of the body portion 40*b* of the operation unit 40, the link portion 41 is also moved in the sliding direction to move the contact slide portion 42 in the sliding direction as well. Thus, the protruding contacting portion (not shown in the drawings) of the contact slide portion 42 is positioned to push the button 160 of the switching portion downward.

With this operation, the contacting portion 141 of the card member 140 is pushed by the inner wall portion 161 of the button 160 so that the card member 140 is rotated around the rotating shaft 143.

Then, the force is applied to the movable plate portions 122 of the movable portions 120 through the upper contacting portion 141 of the card member 140 in a downward direction so that the movable contacting portions 121 and the fixed contacting portions 111 of the fixed portions 110 make contact, respectively.

Figure 12:
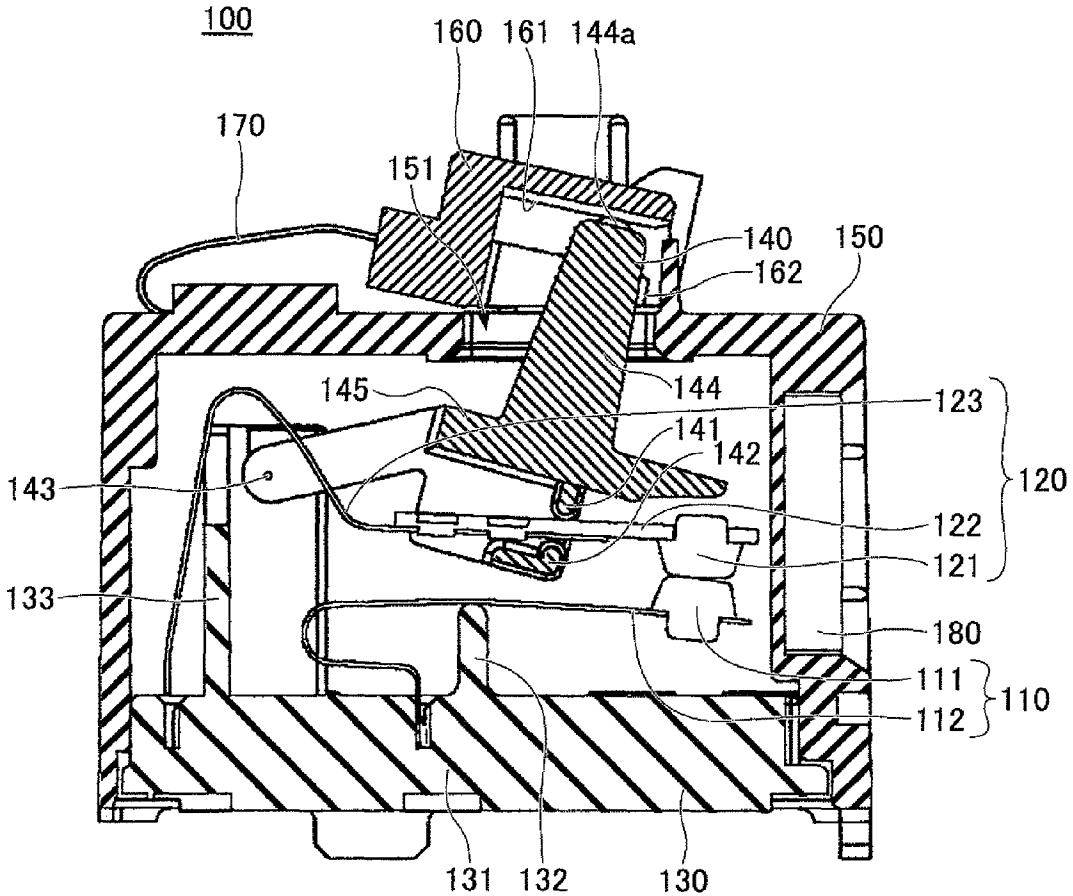
FIG. 12 is a cross-sectional view of an example of the switch device of the first embodiment.

FIG. 12 is a cross-sectional view of the switch device 100 when the fixed contacting portions 111 and the movable contacting portions 121 make contact, respectively.

Although not shown in the drawings, the contact slide portion 42 is configured to maintain this status while the operation unit 40 is positioned at the "ON" position. Thus, the movable contacting portions 121 and the fixed contacting portions 111 are in contact while the operation unit 40 is positioned at the "ON" position so that the electric power is supplied from the power source to the electric device.

Further, when the operation unit 40 is operated to be positioned at the "OFF" position, the contact slide portion 42 is released from pushing the button 160 so that the force applied to the button 160 is released. At this time, the button 160 is moved back in an upper direction by the spring force of the spring 170. With this operation, the card member 140 is rotated around the rotating shaft 143 in the upper direction so that the force in the upward direction is applied to the movable plate portions 122 of the movable portions 120 through the lower contacting portion 142 of the card member 140. Specifically, when the button 160 is moved back in the upper direction, a step portion 162 provided at an inside wall of the button 160 engages with a protruding portion (not shown in the drawings) provided at the card member 140 so that the card member 140 is moved with the button 160 to be rotated around the rotating shaft 143.

Then, the movable contacting portions 121 are moved upward to be apart from the corresponding fixed contacting portions 111 to terminate the supply of the electric power from the power source.

At this time, a case may occur where electric arcs are generated between the movable contacting portions 121 and the corresponding fixed contacting portions 111. Thus, according to the switch device 100 of the embodiment, the permanent magnets 180 are provided near contacting areas of the movable contacting portions 121 and the corresponding fixed contacting portions 111 to blow off the electric arcs by magnetic fields. The permanent magnets 180 are provided to generate the magnetic fields in a direction substantially perpendicular to a direction in which the electric arcs are generated.

Further, in the switch device 100, the spring force of the spring 170, which is provided outside the switch device housing 150, is used to terminate supplying of the electric power from the power source, instead of using the resilience of the springs of the movable portions 120 such as the movable springs 123 or the like. Thus, even when the movable springs 123 of the movable portions 120 do not have the resilience, supplying of the power source can be terminated.

Here, there is a possibility that heat is generated inside the switch device housing 150 so that the fixed portions 110 and the movable portions 120 may be affected by the heat. However, as the spring 170 is provided outside the switch device housing 150, the spring 170 is not affected by the heat generated inside the switch device housing 150.

Therefore, even in a case when a part of the movable springs 123 or the like is melted by the heat generated inside the switch device housing 150, and the movable springs 123 or the like begin to not function as springs, supplying of the power source can be terminated by the spring force of the spring 170 without using the resilience of the movable springs 123 or the like.

It means that supplying of the electric power from the power source can be surely terminated.

Further, in the switch device 100, the insulating wall 133 is provided at the base block 130 between the portion where the other end of the fixed spring 112 is fixed and the portion where the other end of the movable spring 123 is fixed. With this structure, even when a part of the fixed portions 110 and the movable portions 120 is melted by the heat, the melted portion of the fixed portions 110 and melted portion of the movable portions 120 are separated by the insulating wall 133. Thus, a condition in which the melted portion of the fixed portions 110 and the melted portion of the movable portions 120 make contact so that the current of the power source continues to flow (short of the fixed portion 110 and the corresponding movable portion 120), can be prevented from occurring.

Connection to Power Source and Placement of Magnets

The switch device 100 of the embodiment is explained in detail. FIG. 13 is a schematic plan view of an example of the switch device 100 and FIG. 14 is an elevation view of an example of the switch device 100.

The switch device 100 of the embodiment includes a first contacting portion 201*a* and a second contacting portion 201*b* corresponding to the switching portions 201 and a first permanent magnet 180*a* and a second permanent magnet 180*b* corresponding to the permanent magnets 180. The switch device 100 further includes a fixed portion external terminal 113*a*, a fixed portion external terminal 113*b*, a movable portion external terminal 124*a* and a movable portion external terminal 124*b*.

The first contacting portion 201*a* includes a first fixed portion 110*a* and a first movable portion 120*a*. The second contacting portion 201*b* includes a second fixed portion 110*b* and a second movable portion 120*b*. Here, the first fixed portion 110*a* and the second fixed portion 110*b* correspond to the fixed portions 110. The first movable portion 120*a* and the movable portion 120*b* correspond to the movable portions 120.

In the switch device 100 of the embodiment, the electric power from a power source 190 can be supplied to an electronic device 191 when both the first fixed portion 110*a* and the first movable portion 120*a*, and the second fixed portion 110*b* and the second movable portion 120*b* are in contact.

The first fixed portion 110*a* includes a first fixed contacting portion 111*a* and a first fixed spring 112*a* which is electrically connected to the fixed portion external terminal 113*a*. Similarly, the second fixed portion 110*b* includes a second fixed contacting portion 111*b* and a second fixed spring 112*b* which is electrically connected to the fixed portion external terminal 113*b*. The first fixed contacting portion 111*a* and the second fixed contacting portion 111*b* correspond to the fixed contacting portions 111, and the first fixed spring 112*a* and the second fixed spring 112*b* correspond to the fixed springs 112.

The first movable portion 120*a* includes a first movable contacting portion 121*a*, a first movable plate portion 122*a* and a first movable spring 123*a* which is electrically connected to the movable portion external terminal 124*a*. Similarly, the second movable portion 120*b* includes a second movable contacting portion 121*b*, a second movable plate portion 122*b* and a second movable spring 123*b* which is electrically connected to the movable portion external terminal 124*b*. The first movable contacting portion 121*a* and the second movable contacting portion 121*b* correspond to the movable contacting portions 121, the first movable plate portion 122*a* and the second movable plate portion 122*b* correspond to the movable plate portions 122, and the first movable spring 123*a* and the second movable spring 123*b* correspond to the movable springs 123.

Figure 13:
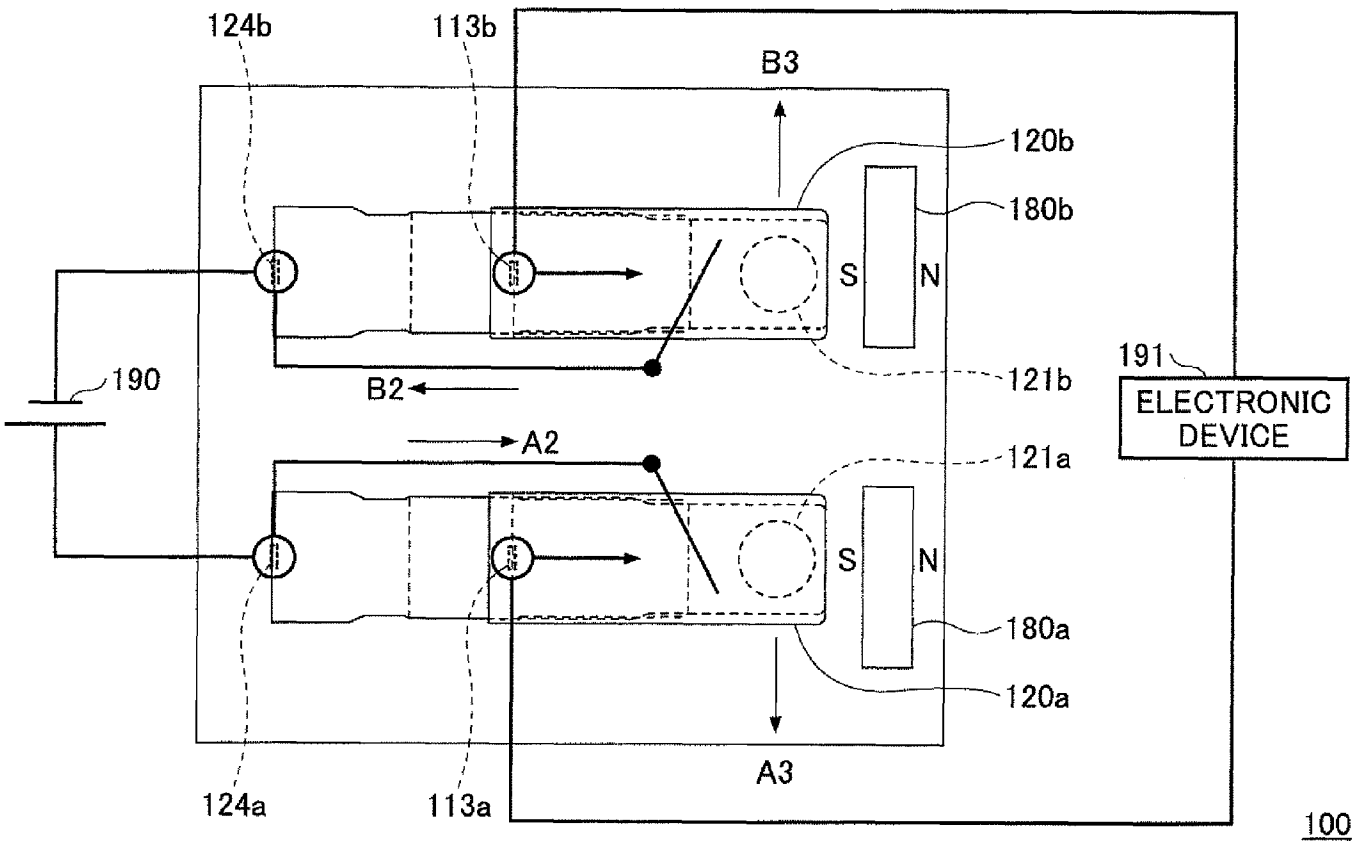
FIG. 13 is a schematic plan view of an example of the switch device of the first embodiment.
Figure 14:
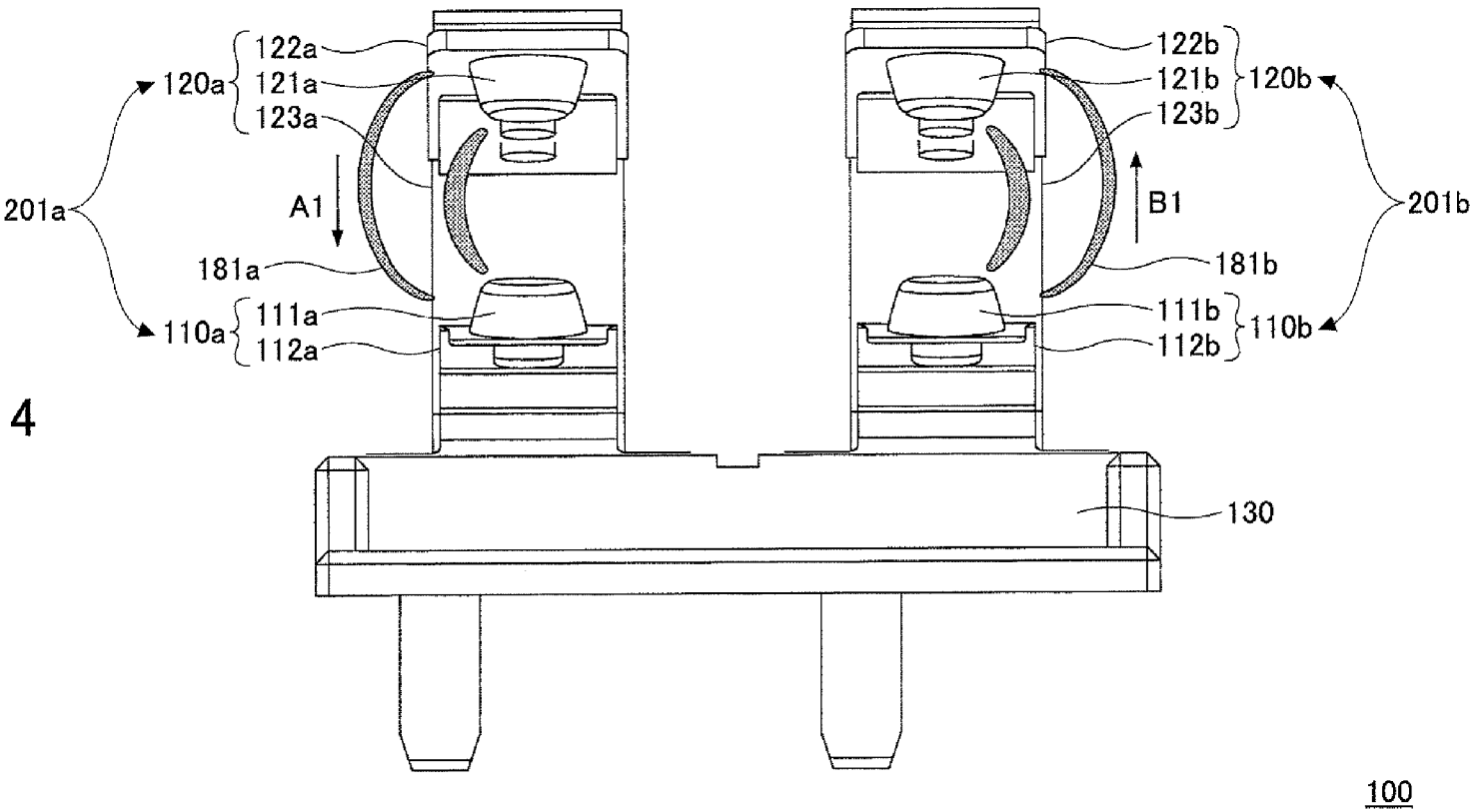
FIG. 14 is an elevation view of an example of the switch device of the first embodiment.

For the embodiment shown in FIG. 13 and FIG. 14, the cathode of the power source 190 is electrically connected to the movable portion external terminal 124*a*, and the anode of the power source 190 is electrically connected the movable portion external terminal 124*b*. Further, the fixed portion external terminal 113*a* is electrically connected to one of the terminals of the electronic device 191 to which the electric power is to be supplied, and the fixed portion external terminal 113*b* is connected to the other of the terminals of the electronic device 191. As described above, in this embodiment, the switch device 100 of the jack connector 10 is electrically connected to the electric device 191 via the plug connector 300, although the plug connector 300 is not shown in FIG. 13.

As shown in FIG. 13 and FIG. 14, under a state where the power source 190 and the electronic device 191 are electrically connected, in other words, both the first fixed contacting portion 111*a* and the first movable contacting portion 121*a* are electrically connected, and the second fixed contacting portion 111*b* and the second movable contacting portion 121*b* are electrically connected, a current is supplied from the cathode of the power source 190 to the movable portion external terminal 124*a*. Then, the current flows through the first movable portion 120*a*, the first fixed portion 110*a* via the first movable contacting portion 121*a* and the first fixed contacting portion 111*a* and the fixed portion external terminal 113*a* in this order to be supplied to the electronic device 191. Then, the current further flows from the electronic device 191 through the fixed portion external terminal 113*b*, the second fixed portion 110*b*, the second movable portion 120*b* via the second fixed contacting portion 111*b* and the second movable contacting portion 121*b*, and the movable portion external terminal 124*b* in this order to reach the anode of the power source 190.

Thus, in the first contacting portion 201*a*, the current from the power source 190 flows from the first movable contacting portion 121*a* toward the first fixed contacting portion 111*a* as shown by an arrow "A1" in FIG. 14. It means that electrons flow in a direction different from, in this embodiment, opposite to, the arrow "A1" in FIG. 14 from the first fixed contacting portion 111*a* to the first movable contacting portion 121*a*. In other words, the electrons discharged from the first fixed contacting portion 111*a* collide and move toward the first movable contacting portion 121*a*.

Further, in the second contacting portion 201*b*, the current flows from the second fixed contacting portion 111*b* toward the second movable contacting portion 121*b* as shown by an arrow "B1" in FIG. 14. It means that electrons flow in a direction different from, in this embodiment, opposite to, the arrow "B1" in FIG. 14 from the second movable contacting portion 121*b* to the second fixed contacting portion 111*b*. In other words, the electrons discharged from the second movable contacting portion 121*b* collide and move toward the second fixed contacting portion 111*b*.

Further, an arrow "A2" shown in FIG. 13 shows a direction of the current that flows through the first movable portion 120*a*, and an arrow "B2" shows a direction of the current that flows through the second movable portion 120*b*.

The first permanent magnet 180*a* is provided to correspond to the first fixed portion 110*a* and the first movable portion 120*a*. The first permanent magnet 180*a* has a function to blow off an electric arc generated between the first fixed contacting portion 111*a* and the first movable contacting portion 121*a* by a magnetic field.

Similarly, the second permanent magnet 180*b* is provided to correspond to the second fixed portion 110*b* and the second movable portion 120*b*. The second permanent magnet 180*b* has a function to blow off an electric arc generated between the second fixed contacting portion 111*b* and the second movable contacting portion 121*b* by a magnetic field.

In this embodiment, the first permanent magnet 180*a* and the second permanent magnet 180*b* are provided such that the directions to blow off the electric arcs generated between the first fixed contacting portion 111*a* and the first movable contacting portion 121*a*, and between the second fixed contacting portion 111*b* and the second movable contacting portion 121*b* become opposite from each other.

Specifically, in this embodiment, the first permanent magnet 180*a* may be provided such that an electric arc 181*a* (see FIG. 14) generated between the first fixed contacting portion 111*a* and the first movable contacting portion 121*a* is blown off in an outward direction (a direction opposite to the second contacting portion 201*b*) shown by an arrow "A3" in FIG. 13. Similarly, in this embodiment, the second permanent magnet 181*b* may be provided such that an electric arc 181*b* (see FIG. 14) generated between the second fixed contacting portion 111*b* and the second movable contacting portion 121*b* is blown off in an outward direction (a direction opposite to the first contacting portion 201*a*) shown by an arrow "B3" in FIG. 13.

Thus, in this embodiment, the first permanent magnet 180*a* and the second permanent magnet 180*b* are provided to generate magnetic fields in the same directions as the current flow between the first fixed contacting portion 111*a* and the first movable contacting portion 121*a*, and between the second fixed contacting portion 111*b* and the second movable contacting portion 121*b*, respectively, which are in different directions. Specifically, the first permanent magnet 180*a* is placed such that the South Pole faces the side where the first fixed contacting portion 111*a* and the first movable contacting portion 121*a* are provided. Similarly, the second permanent magnet 180*b* is placed such that the South Pole faces the side where the second fixed contacting portion 111*b* and the second movable contacting portion 121*b* are provided.

With this structure, the magnetic field by the first permanent magnet 180*a* is generated between the first fixed contacting portion 111*a* and the first movable contacting portion 121*a*, and the magnetic field by the second permanent magnet 180*b* is generated between the second fixed contacting portion 111*b* and the second movable contacting portion 121*b*.

Alternatively, instead of the first permanent magnet 180*a* and the second permanent magnet 180*b*, electro-magnets may be used.

Here, the contacting portions (the first movable contacting portion 121*a* or the second fixed contacting portion 111*b* in this embodiment) with which the electrons collide tend to be heated and easily become a high temperature. Especially, the second fixed contacting portion 111*b* is formed on the second fixed spring 112*b* which has a relatively small thickness (see FIG. 11 where the fixed contacting portion 111 and the fixed spring 112 correspond to the second fixed contacting portion 111*b* and the second fixed spring 112*b*, respectively, for example). Therefore, the second fixed contacting portion 111*b* and the second fixed spring 112*b* tend to be heated easily. In such a case, the second fixed contacting portion 111*b* and the second fixed spring 112*b* may be melted by the heat generated by the collision of the electrons to cause a failure such as a breakage, a short or the like. When such a failure, especially a short, occurs, it is impossible to break or stop supplying of the electric power from the power source 190 to the electronic device 191.

On the other hand, for the first movable contacting portion 121*a*, the first movable contacting portion 121*a* is formed on the first movable plate portion 122*a* which has a relatively large thickness (see FIG. 11 where the movable contacting portion 121 and the movable plate portion 122 correspond to the first movable contacting portion 121*a* and the first movable plate portion 122*a*, respectively, for example). Therefore, even when the heat is generated at the first movable contacting portion 121*a* by the collision of the electrons, as heat capacity of the first movable plate portion 122*a* is large, the first movable contacting portion 121*a* and the first movable plate portion 122*a* do not become a high temperature. Thus, the first movable contacting portion 121*a*, the first movable plate portion 122*a* and the first movable spring 123*a* avoid being melted to cause a failure such as a breakage, a short, or the like. Thus, a structure in which electrons are to collide with the movable contacting portions, instead of the fixed contacting portions, may be provided as follows.

Another Example of Connection to Power Source and Placement of Magnets

Figure 15:
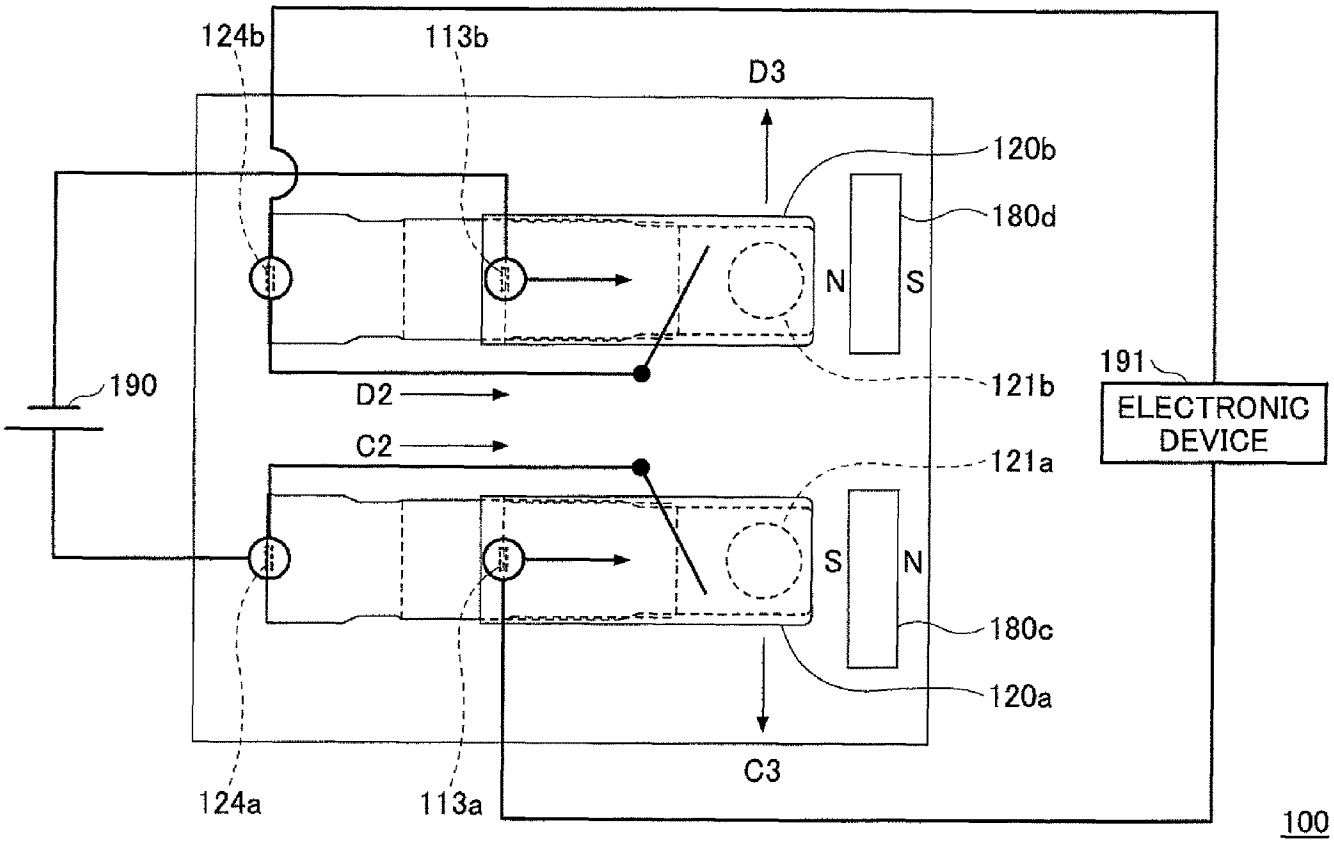
FIG. 15 is a schematic plan view of another example of the switch device of the first embodiment.
Figure 16:
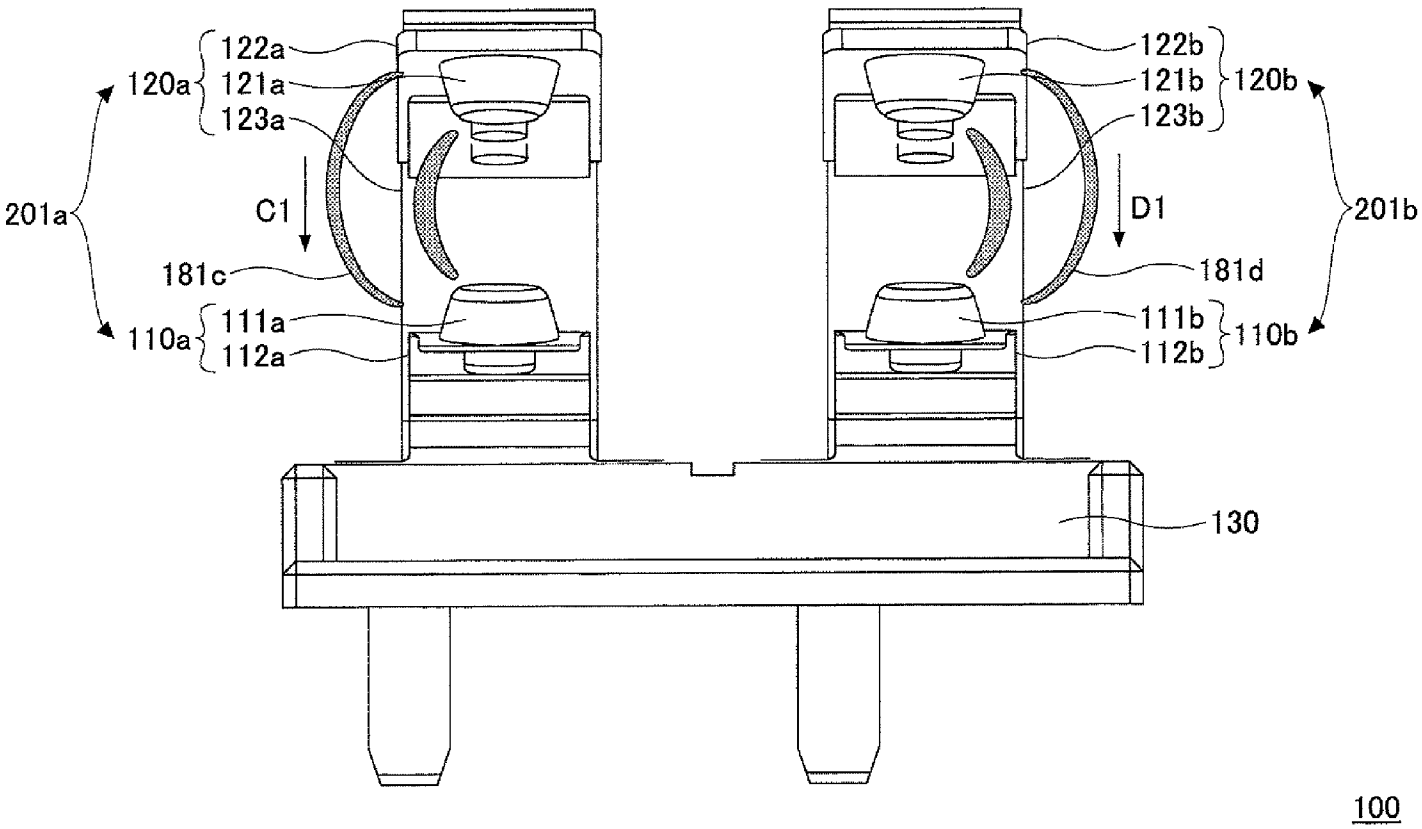
FIG. 16 is an elevation view of another example of the switch device of the first embodiment.

Another example of the connection to the power source 190 and the placement of the permanent magnets is explained. FIG. 15 is a schematic plan view of another example of the switch device 100 and FIG. 16 is an elevation view of another example of the switch device 100.

The switch device 100 of the embodiment includes a first permanent magnet 180*c* and a second permanent magnet 180*d* instead of the first permanent magnet 180*a* and the second permanent magnet 180*b* shown in FIG. 13.

Further, in this example, the cathode of the power source 190 is electrically connected to the movable portion external terminal 124*a*, and the anode of the power source 190 is electrically connected to the fixed portion external terminal 113*b*, which is different from that shown in FIG. 13. Further, the fixed portion external terminal 113*a* is connected to one of the terminals of the electronic device 191 to which the electric power is to be supplied, and the movable portion external terminal 124*b* is connected to the other of the terminals of the electronic device 191, which is different from that shown in FIG. 13.

The first permanent magnet 180*c* is provided to correspond to the first fixed portion 110*a* and the first movable portion 120*a*. The first permanent magnet 180*c* has a function to blow off an electric arc generated between the first fixed contacting portion 111*a* and the first movable contacting portion 121*a* by a magnetic field.

Similarly, the second permanent magnet 180*d* is provided to correspond to the second fixed portion 110*b* and the second movable portion 120*b*. The second permanent magnet 180*d* has a function to blow off an electric arc generated between the second fixed contacting portion 111*b* and the second movable contacting portion 121*b* by a magnetic field.

In this example, as will be explained later in detail, the first permanent magnet 180*c* and the second permanent magnet 180*d* are provided such that the directions of generated magnetic fields are opposite from each other.

As shown in FIG. 15 and FIG. 16, under a state where the power source 190 and the electronic device 191 are electrically connected, in other words, both the first fixed contacting portion 111*a* and the first movable contacting portion 121*a*, and the second fixed contacting portion 111*b* and the second movable contacting portion 121*b* are electrically connected, a current is supplied from the cathode of the power source 190 to the movable portion external terminal 124*a*. Then, the current flows through the first movable portion 120*a*, the first fixed portion 110*a* via the first movable contacting portion 121*a* and the first fixed contacting portion 111*a*, and the fixed portion external terminal 113*a* in this order to be supplied to the electronic device 191. Then, the current further flows from the electronic device 191 through the movable portion external terminal 124*b*, the second movable portion 120*b*, the second fixed portion 110*b* via the second movable contacting portion 121*b* and the second fixed contacting portion 111*b*, and the fixed portion external terminal 113*b* to reach the anode of the power source 190.

Thus, in the first contacting portion 201*a*, the current from the power source 190 flows from the first movable contacting portion 121*a* toward the first fixed contacting portion 111*a* as shown by an arrow "C1" in FIG. 16, which is the same as the arrow "A1" in FIG. 14. It means that electrons flow in a direction opposite to the arrow "C1" in FIG. 16 from the first fixed contacting portion 111*a* to the first movable contacting portion 121*a*. In other words, the electrons discharged from the first fixed contacting portion 111*a* collide and move toward the first movable contacting portion 121*a*.

Further, in the second contacting portion 201*b*, the current flows from the second movable contacting portion 121*b* toward the second fixed contacting portion 111*b* as shown by an arrow "D1" in FIG. 16, which is opposite to the arrow "B1" in FIG. 14. It means that electrons flow in a direction opposite to the arrow "D1" in FIG. 16 from the second fixed contacting portion 111*b* to the second movable contacting portion 121*b*. In other words, the electrons discharged from the second fixed contacting portion 111*b* collide and move toward the second movable contacting portion 121*b*.

For the case shown in FIG. 15 and FIG. 16, the electrons are discharged from the first fixed contacting portion 111*a* and the second fixed contacting portion 111*b*, respectively. Then, the discharged electrons collide with the first movable contacting portion 121*a* and the second movable contacting portion 121*b*, respectively. As described above, at the first movable contacting portion 121*a* and the second movable contacting portion 121*b*, the first movable plate portion 122*a* and the second movable plate portion 122*b* are formed thicker than the first fixed spring 112*a* and the second fixed spring 112*b*. Thus, even when large amounts of heat are generated at the first movable plate portion 122*a* and the second movable plate portion 122*b* by the collision of the electrons, since heat capacities of the first movable plate portion 122*a* and the second movable plate portion 122*b* are large, the first movable portion 120*a* and the second movable portion 120*b* do not reach a high temperature. Thus, the first movable contacting portion 121*a*, the first movable plate portion 122*a* and the first movable spring 123*a*, or the second movable contacting portion 121*b*, the second movable plate portion 122*b* and the second movable spring 123*b* are unlikely to be melted to cause a failure such as a breakage, a short or the like.

Further, an arrow "C2" shown in FIG. 15 shows a direction of the current that flows through the first movable portion 120*a*, and an arrow "D2" shows a direction of the current that flows through the second movable portion 120*b*.

In this embodiment, similar to the first permanent magnet 180*a* and the second permanent magnet 180*b*, the first permanent magnet 180*c* and the second permanent magnet 180*d* are provided such that the directions to blow off the electric arcs generated between the first fixed contacting portion 111*a* and the first movable contacting portion 121*a*, and between the second fixed contacting portion 111*b* and the second movable contacting portion 121*b* become opposite from each other.

Specifically, in this example, the first permanent magnet 180*c* may be provided such that an electric arc 181*c* (see FIG. 16) generated between the first fixed contacting portion 111*a* and the first movable contacting portion 121*a* is blown off in an outward direction (a direction opposite to the second contacting portion 201*b*) shown by an arrow "C3" in FIG. 15. Similarly, in this example, the second permanent magnet 181*d* may be provided such that an electric arc 181*d* (see FIG. 16) generated between the second fixed contacting portion 111*b* and the second movable contacting portion 121*b* is blown off in an outward direction (a direction opposite to the first contacting portion 201*a*) shown by an arrow "D3" in FIG. 15.

Thus, in this embodiment, the first permanent magnet 180*c* and the second permanent magnet 180*d* are provided such that positions of the South Poles and the North poles are different from each other.

Specifically, the first permanent magnet 180*c* is placed such that the South Pole faces the side where the first fixed contacting portion 111*a* and the first movable contacting portion 121*a* are provided. Thus, the first permanent magnet 180*c* has a function to blow off the electric arc 181*c* (see FIG. 16) generated between the first fixed contacting portion 111*a* and the first movable contacting portion 121*a* by a magnetic field in the direction shown by the arrow "C3" shown in FIG. 15.

Specifically, the second permanent magnet 180*d* is placed such that the North Pole faces the side where the second fixed contacting portion 111*b* and the second movable contacting portion 121*b* are provided. Thus, the second permanent magnet 180*d* has a function to blow off the electric arc 181*d* (see FIG. 16) generated between the second fixed contacting portion 111*b* and the second movable contacting portion 121*b* by a magnetic field in the direction shown by the arrow "D3" shown in FIG. 15.

Intensity of Magnetic Field

Next, intensity of magnetic field between plural magnets is explained.

Figure 17:
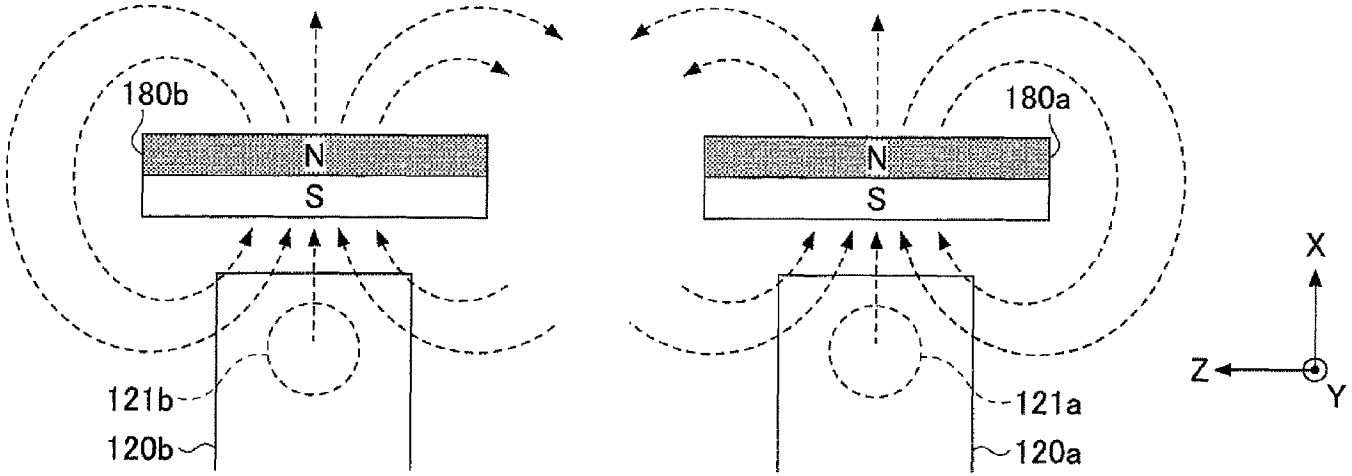
FIG. 17 is a view showing magnetic flux generated in the switch device shown in FIG. 13 and FIG. 14.

FIG. 17 is a view showing magnetic flux by dotted lines when the first permanent magnet 180*a* and the second permanent magnet 180*b* are provided as shown in FIG. 13 and FIG. 14. In this example, the first permanent magnet 180*a* and the second permanent magnet 180*b* are placed such that their South Poles face the side where both the first movable portion 120*a* and the second movable portion 120*b* are provided.

Figure 18:
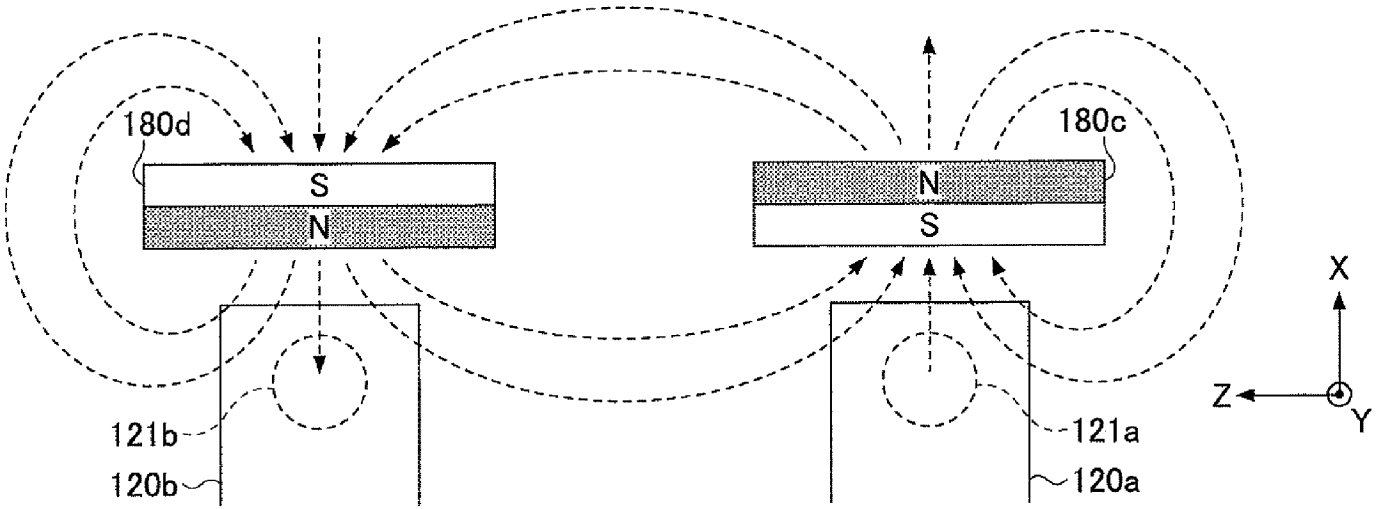
FIG. 18 is a view showing magnetic flux generated in the switch device shown in FIG. 15 and FIG. 16.

FIG. 18 is a view showing magnetic flux by dotted lines when the first permanent magnet 180*c* and the second permanent magnet 180*d* are provided as shown in FIG. 15 and FIG. 16. In this example, the first permanent magnet 180*c* is placed such that its South Pole faces the side where the first movable portion 120*a* is provided and the second permanent magnet 180*d* is placed such that its North Pole faces the side where the second movable portion 120*b* is provided.

By comparing the views shown in FIG. 17 and FIG. 18, the magnetic flux is more closed in FIG. 18 than that shown in FIG. 17. It means that magnetic flux densities at contacting areas of the fixed contacting portion (111*a* or 111*b*) and the movable contacting portion (121*a* or 121*b*) can be made higher for the case shown in FIG. 18 than the case shown in FIG. 17.

Specifically, by a simulation in which it is assumed that the magnetic flux densities of the permanent magnets 180*a* to 180*d* are the same, the following results are revealed. Magnetic flux density of the first movable portion 120*a* and the second movable portion 120*b* at the first movable contacting portion 121*a* and the second 121*b* movable contacting portion for the case shown in FIG. 17, is 6.32 mT in a "Z" direction and 73.74 mT in an "X" direction. Magnetic flux density of the first movable portion 120*a* and the second movable portion 120*b* at the first movable contacting portion 121*a* and the second 121*b* movable contacting portion for the case shown in FIG. 18, is 17.38 mT in a "Z" direction and 80.54 mT in an "X" direction.

As described above, by placing the first permanent magnet 180*c* and the second permanent magnet 180*d* as shown in FIG. 18 (or FIG. 15 and FIG. 16), the magnetic flux density at the contacting areas of the fixed contacting portion (111*a* or 111*b*) and the movable contacting portion (121*a* or 121*b*) can be made higher compared with the case shown in FIG. 17. In other words, by placing plural permanent magnets such that the polar characteristics of the adjacent permanent magnets become opposite from each other, the magnetic flux densities at contacting areas of the fixed contacting portion (111*a* or 111*b*) and the movable contacting portion (121*a* or 121*b*) can be made higher so that the electric arcs can be blown off by the stronger forces.

Figure 23:
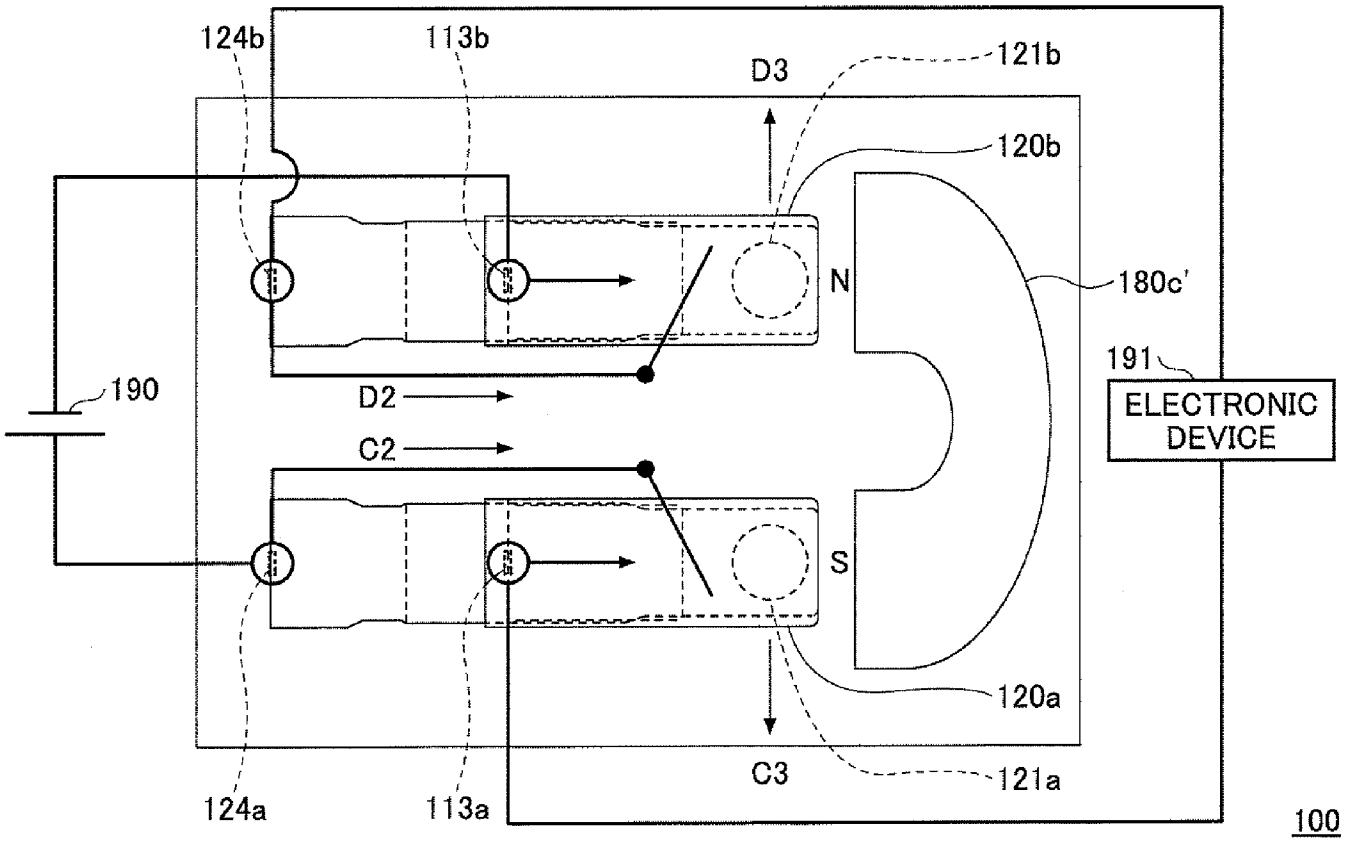
FIG. 23 is a schematic plan view of an example of the switch device of an embodiment.

In the above embodiments, the first permanent magnet 180*a* and the second permanent magnet 180*b*, or the first permanent magnet 180*c* and the second permanent magnet 180*d* are configured to compose the magnet unit. In other words, the first permanent magnet 180*a* or 180*c* and the second permanent magnet 180*b* or 180*d* are provided respectively for the first contacting portion 201*a* and the second contacting portion 201*b*. However, the first permanent magnet 180*a* and the second permanent magnet 180*b*, or the first permanent magnet 180*c* and the second permanent magnet 180*d* may be formed to be a common magnet for the first contacting portion 201*a* and the second contacting portion 201*b*. It means that the magnet unit may include a single magnet commonly provided for the first contacting portion 201*a* and the second contacting portion 201*b*. For example, for the case shown in FIG. 15, FIG. 16 and FIG. 18, the first permanent magnet 180*c* and the second permanent magnet 180*d* may be formed by a single magnet in which the South Pole and the North pole are provided at the same side to correspond to the first contacting portion 201*a* and the second contacting portion 201*b*, respectively. For example, a magnet in which the South Pole and the North pole are provided in the same vicinity such as a horseshoe magnet may be used. FIG. 23 is a schematic plan view of another example of the switch device 100. In this case, the magnet unit is a horseshoe magnet 181*c*' in which the South Pole and the North pole are provided in the vicinity.

Second Embodiment

For the switch device or the like, when a failure such as a breakage or a short occurs between the movable contacting portion and the fixed contacting portion, the short of the contacting portions is more fatal compared with the breakage. For the case of breakage, even when breakage occurs, the result is just that the electric power from the power source or the like is not supplied. Thus, there is no problem in an aspect of safety. However, for the case of a short, if the short occurs, supplying of the electric power from the power source or the like continues and cannot be stopped. Thus, the failure expands and the problem in the aspect of safety occurs. Thus, it is better to cause the breakage rather than causing the short, if any failure occurs. In the second embodiment, the switch device 100 is configured to cause the breakage rather than the short.

Figure 19:
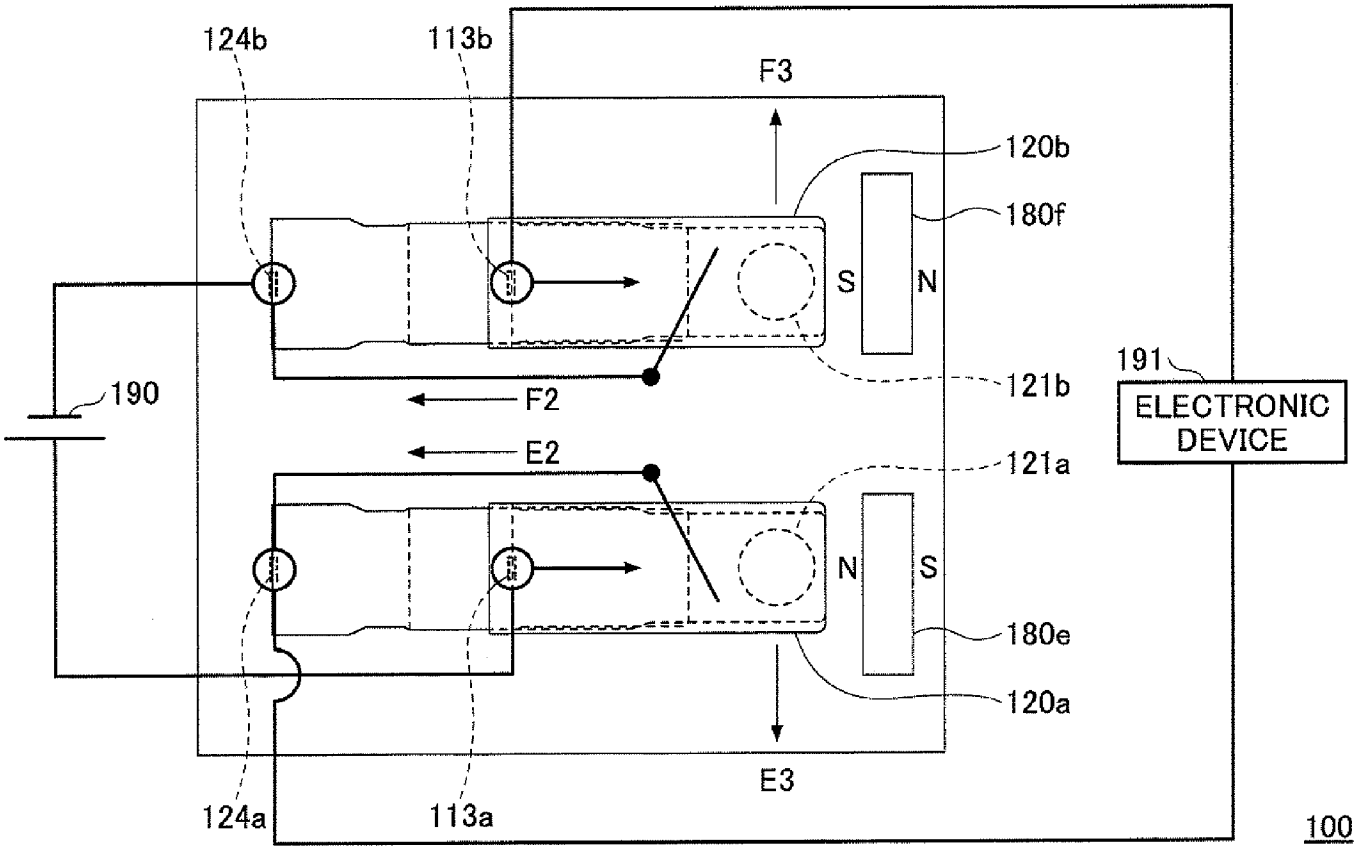
FIG. 19 is a schematic plan view of an example of the switch device of a second embodiment.
Figure 20:
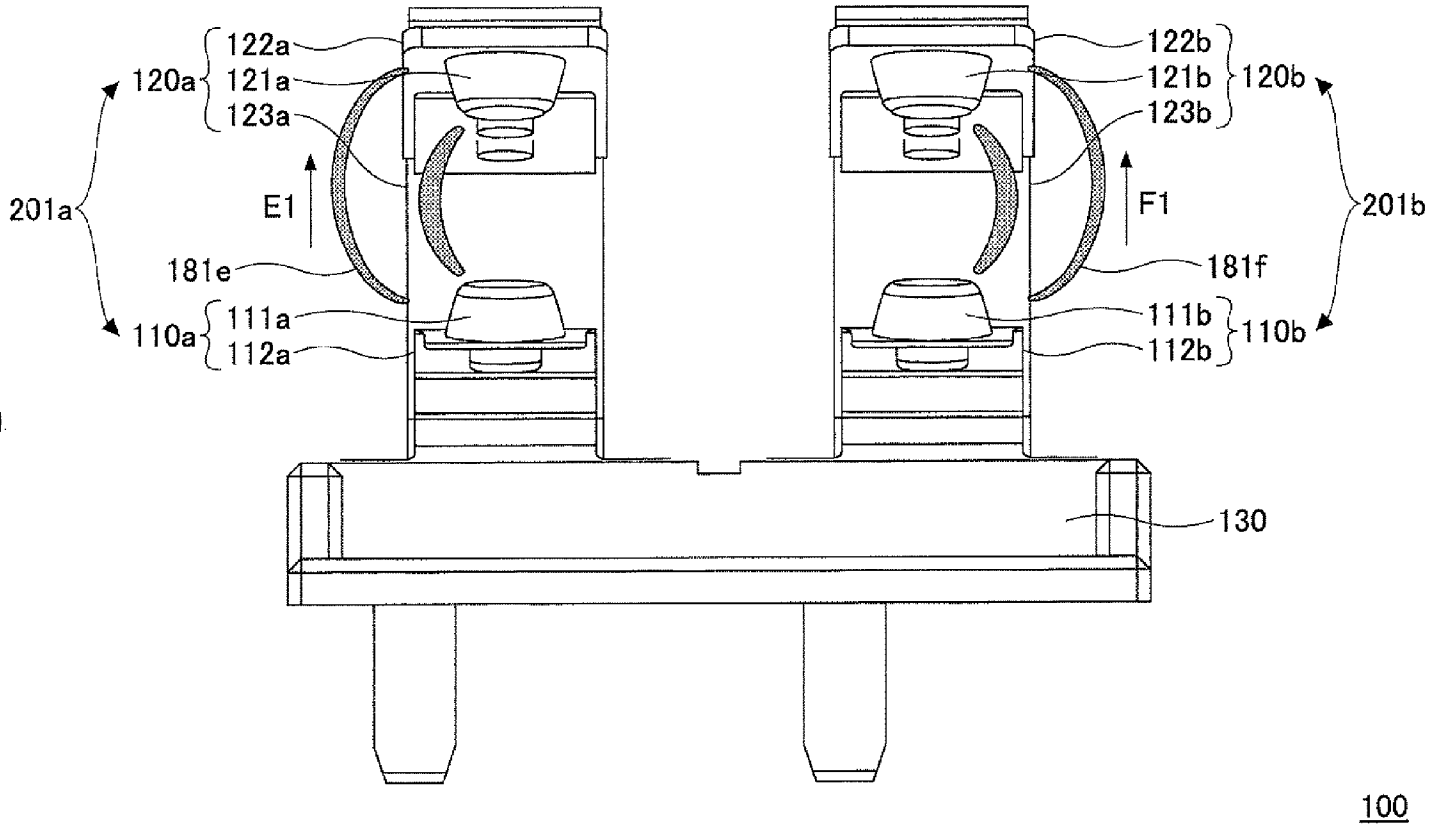
FIG. 20 is an elevation view of an example of the switch device of the second embodiment.

FIG. 19 is a schematic plan view of an example of the switch device 100 and FIG. 20 is an elevation view of an example of the switch device 100, of the second embodiment. In this embodiment, the connection between the switch device 100, and the power source 190 and the electronic device 191 is different from that explained in the first embodiment.

Specifically, as shown in FIG. 19 and FIG. 20, the cathode of the power source 190 is electrically connected to the fixed portion external terminal 113*a* which is connected to the first fixed portion 110*a*, and the anode of the power source 190 is electrically connected to the movable portion external terminal 124*b* which is connected to the second movable portion 120*b*. Further, the fixed portion external terminal 113*b* which is connected to the second fixed portion 110*b* is electrically connected to one of the terminals of the electronic device 191 to which the electric power is to be supplied, and the movable portion external terminal 124*a* which is connected to the first movable portion 120*a* is electrically connected to the other of the terminals of the electronic device 191.

Further, the switch device 100 of the embodiment includes a first permanent magnet 180*e* and a second permanent magnet 180*f* instead of the first permanent magnet 180*a* or 180*c* and the second permanent magnet 180*b* or 180*d* explained in the first embodiment. In this embodiment, similar to the first permanent magnet 180*c* and the second permanent magnet 180*d* shown in FIG. 15, the first permanent magnet 180*e* and the second permanent magnet 180*f* are provided such that the directions of generated magnetic fields are opposite from each other.

In this embodiment, under a state where the power source 190 and the electronic device 191 are electrically connected, in other words, both the first fixed contacting portion 111*a* and the first movable contacting portion 121*a*, and the second fixed contacting portion 111*b* and the second movable contacting portion 121*b* are electrically connected, a current is supplied from the cathode of the power source 190 to the fixed portion external terminal 113*a*. Then, the current flows through the first fixed portion 110*a*, the first movable portion 120*a* via the first fixed contacting portion 111*a* and the first movable contacting portion 121*a*, and the movable portion external terminal 124*a* in this order to be supplied to the electronic device 191. Then, the current further flows from the electronic device 191 through the fixed portion external terminal 113*b*, the second fixed portion 110*b*, the second movable portion 120*b* via the second fixed contacting portion 111*b* and the second movable contacting portion 121*b*, and the movable portion external terminal 124*b* to reach the anode of the power source 190.

Thus, in the first contacting portion 201*a*, the current from the power source 190 flows from the first fixed contacting portion 111*a* toward the first movable contacting portion 121*a* as shown by an arrow "E1" in FIG. 20, which is opposite to the arrow "A1" in FIG. 14 of the first embodiment. It means that electrons flow in a direction opposite to the arrow "E1" in FIG. 20 from the first movable contacting portion 121*a* to the first fixed contacting portion 111*a*. In other words, the electrons discharged from the first movable contacting portion 121*a* collide and move toward the first fixed contacting portion 111*a*.

Further, in the second contacting portion 201*b*, the current flows from the second fixed contacting portion 111*b* toward the second movable contacting portion 121*b* as shown by an arrow "F1" in FIG. 20, which is the same as the arrow "B1" in FIG. 14. It means that electrons flow in a direction opposite to the arrow "F1" in FIG. 20 from the second movable contacting portion 121*b* to the second fixed contacting portion 111*b*. In other words, the electrons discharged from the second movable contacting portion 121*b* collide and move toward the second fixed contacting portion 111*b*.

In this embodiment, the electrons are discharged from the movable contacting portions (the first movable contacting portion 121*a* and the second movable contacting portion 121*b*), and the discharged electrons collide with the fixed contacting portions (the first fixed contacting portion 111*a* and the second fixed contacting portion 111*b*). As described above, the first fixed contacting portion 111*a* and the second fixed contacting portion 111*b* do not include the movable plate portions like the first movable plate portion 122*a* and the second movable plate portion 122*b* of the first movable portion 120*a* and the second movable portion 120*b*, respectively. The first fixed spring 112*a* and the second fixed spring 112*b* are thin and have small heat capacities. Thus, the first fixed contacting portion 111*a* and the second fixed contacting portion 111*b* tend to be too easily melted by the heat generated by the collision of the electrons with the first fixed contacting portion 111*a* and the second fixed contacting portion 111*b*.

However, in this embodiment, the first fixed portion 110*a* and the second fixed portion 110*b* are provided below the first movable portion 120*a* and the second movable portion 120*b*, respectively as shown in FIG. 20. Thus, even when the first fixed spring 112*a* and the second fixed spring 112*b* or the like of the first fixed portion 110*a* and the second fixed portion 110*b* are melted or become soft, the melted portions of the first fixed spring 112*a* and the second fixed spring 112*b* or the like move downward by the force of gravity. Therefore, the first fixed portion 110*a* and the second fixed portion 110*b* do not contact the first movable contacting portion 121*a* and the second movable contacting portion 121*b* of the first movable portion 120*a* and the second movable portion 120*b*, respectively, to prevent the occurrence of the short while the breakage may occur.

Further, an arrow "E2" shown in FIG. 19 shows a direction of the current that flows through the first movable portion 120*a*, and an arrow "F2" shows a direction of the current that flows through the second movable portion 120*b*.

In this embodiment, similar to the first permanent magnet 180*a* or 180*c* and the second permanent magnet 180*b* or 180*d*, the first permanent magnet 180*e* and the second permanent magnet 180*f* are provided such that the directions to blow off the electric arcs generated between the first fixed contacting portion 111*a* and the first movable contacting portion 121*a*, and between the second fixed contacting portion 111*b* and the second movable contacting portion 121*b* become opposite from each other.

Specifically, in this example, the first permanent magnet 180*e* may be provided such that an electric arc 181*e* (see FIG. 20) generated between the first fixed contacting portion 111*a* and the first movable contacting portion 121*a* is blown off in an outward direction (a direction opposite to the second contacting portion 201*b*) shown by an arrow "E3" in FIG. 19. Similarly, in this example, the second permanent magnet 180*f* may be provided such that an electric arc 181*f* (see FIG. 20) generated between the second fixed contacting portion 111*b* and the second movable contacting portion 121*b* is blown off in an outward direction (a direction opposite to the first contacting portion 201*a*) shown by an arrow "F3" in FIG. 19.

Thus, in this embodiment, the first permanent magnet 180*e* and the second permanent magnet 180*f* are provided such that positions of the South Poles and the North poles are different from each other.

Specifically, the first permanent magnet 180*e* is placed such that the North pole faces the side where the first fixed contacting portion 111*a* and the first movable contacting portion 121*a* are provided. Thus, the first permanent magnet 180*e* has a function to blow off the electric arc 181*e* (see FIG. 20) generated between the first fixed contacting portion 111*a* and the first movable contacting portion 121*a* by a magnetic field in the direction shown by the arrow "E3" in FIG. 19.

Specifically, the second permanent magnet 180*f* is placed such that the South Pole faces the side where the second fixed contacting portion 111*b* and the second movable contacting portion 121*b* are provided. Thus, the second permanent magnet 180*f* has a function to blow off the electric arc 181*f* (see FIG. 20) generated between the second fixed contacting portion 111*b* and the second movable contacting portion 121*b* by a magnetic field in the direction shown by the arrow "F3" shown in FIG. 19.

Separation Cover

Figure 21:
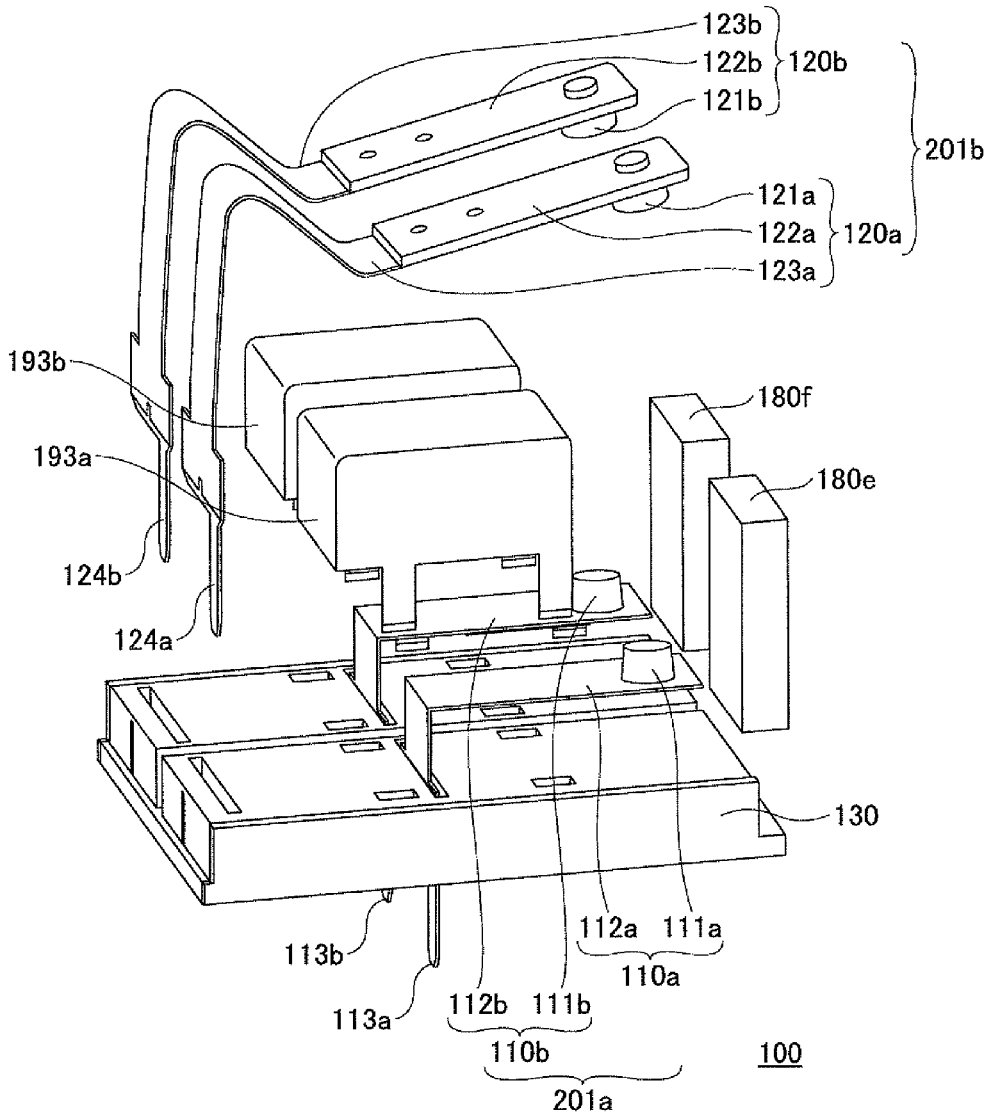
FIG. 21 is an exploded perspective view of another example of the switch device of the second embodiment.
Figure 22:
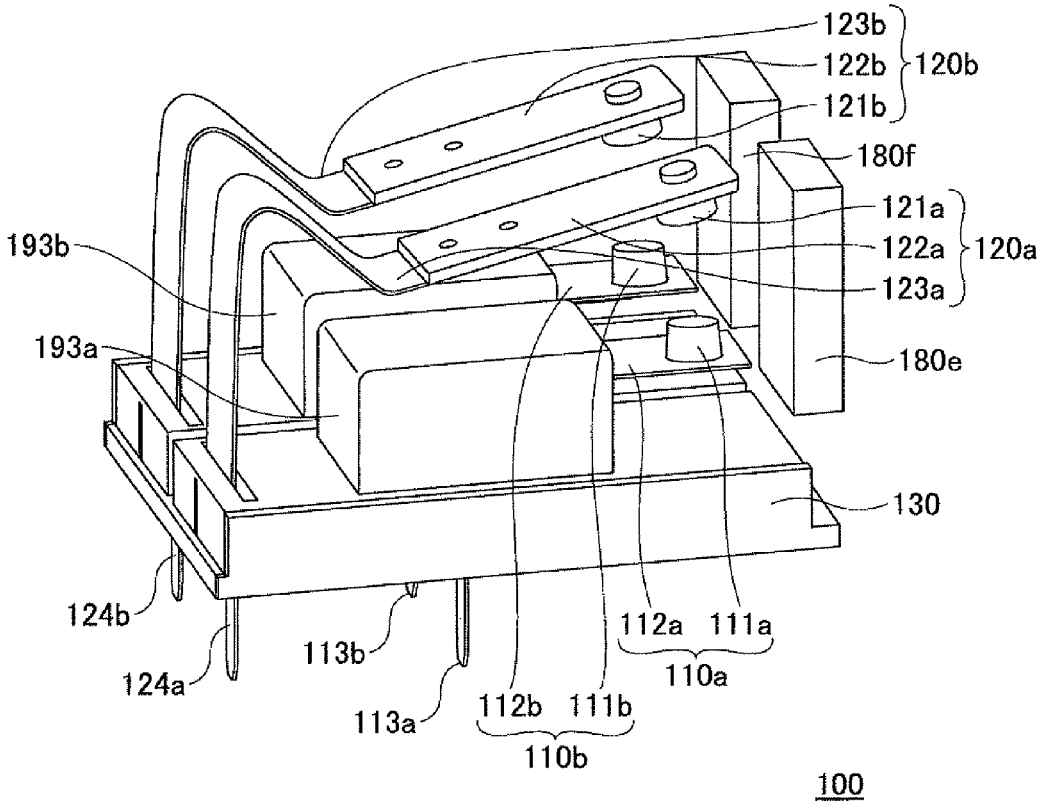
FIG. 22 is a perspective view of another example of the switch device of the second embodiment.

FIG. 21 is an exploded perspective view of another example of the switch device 100 and FIG. 22 is a perspective view of another example of the switch device 100, of the second embodiment.

In this example, the switch device 100 further includes a separation cover 193*a* and a separation cover 193*b* respectively provided between the first fixed portion 110*a* and the first movable portion 120*a*, and between the second fixed portion 110*b* and the second movable portion 120*b*. The separation cover 193*a* is provided to separate the first fixed portion 110*a* and the first movable portion 120*a*, and the separation cover 193*b* is provided to separate the second fixed portion 110*b* and the second movable portion 120*b*.

The separation covers 193*a* and 193*b* are formed to cover a part of the first fixed portion 110*a* and the second fixed portion 110*b* while exposing the first fixed contacting portion 111*a* and the second fixed contacting portion 111*b*, respectively. In other words, the separation cover 193*a* is provided between the first fixed spring 112*a* of the first fixed portion 110*a* and the first movable spring 123*a* and the first movable plate portion 122*a* of the first movable portion 120*a*. Similarly, the separation cover 193*b* is provided between the second fixed spring 112*b* of the second fixed portion 110*b* and the second movable spring 123*b* and the second movable plate portion 122*b* of the second movable portion 120*b*.

Specifically, the separation covers 193*a* and 193*b* are respectively formed in a box shape where a wall may not be provided at a side facing the first fixed contacting portion 111*a* and the first movable contacting portion 121*a*, or the second fixed contacting portion 111*b* and the second movable contacting portion 121*b*.

Further, for the separation cover 193*a*, in order to have the first fixed contacting portion 111*a* contact the first movable contacting portion 121*a*, the separation cover 193*a* is not provided between the first fixed contacting portion 111*a* and the first movable contacting portion 121*a*. Similarly, for the separation cover 193*b*, in order to have the second fixed contacting portion 111*b* contact the second movable contacting portion 121*b*, the separation cover 193*b* is not provided between the second fixed contacting portion 111*b* and the second movable contacting portion 121*b*.

By providing the separation covers 193*a* and 193*b*, even when the first fixed spring 112*a* or the second fixed spring

112*b* is melted or becomes soft by the heat generated by the electric arc or the like, the first fixed spring 112*a* or the second fixed spring 112*b* is prevented from contacting the first movable portion 120*a* or the second movable portion 120*b*, respectively. Therefore, the short between the first movable portion 120*a* and the first fixed portion 110*a* or the second movable portion 120*b* and the second fixed portion 110*b* can be prevented.

Further, even when the first movable spring 123*a* and the first movable plate portion 122*a* are melted or become soft by the heat generated by the electric arcs or the like, it can be prevented that the first movable spring 123*a* and the first movable plate portion 122*a* contact the first fixed portion 110*a*. Similarly, even when the second movable spring 123*b* and the second movable plate portion 122*b* are melted or become soft by the heat generated by the electric arcs or the like, it can be prevented that the second movable spring 123*b* and the second movable plate portion 122*b* contact the second fixed portion 110*b*. Thus, shorts can be prevented.

The separation covers 193*a* and 193*b* may be made of an insulating material and a material whose melting point is high, such as a resin material such as a plastic of the like having a high-melting point, or ceramics such as aluminum oxide or the like, for example. Further, the separation covers 193*a* and 193*b* may be made of a metal layer and an insulating layer formed on the metal layer, for example. Further, the separation covers 193*a* and 193*b* may be made of a metal or the like provided that only the first fixed spring 112*a* and the second fixed spring 112*b* are melted. In other words, any materials can be used for the cover provided that the insulation between the first fixed portion 110*a* and the first movable portion 120*a*, and the second fixed portion 110*b* and the second movable portion 120*b* can be ensured even when the first fixed spring 112*a* and the second fixed spring 112*b* or the like are melted or become soft by the heat.

Other components not specifically explained in the second embodiment are similar to those of the first embodiment. Further, the switch device 100 of the second embodiment may be incorporated into the jack connector 10 explained in the first embodiment.

Further, the first permanent magnet 180*e* and the second permanent magnet 180*f* may be provided as a common magnet for the first contacting portion 201*a* and the second contacting portion 201*b*.

According to the above embodiments, a switch device, which can correspond to a power source of a voltage higher than that of the current commercial power source or a direct current power source, with safety and reliability can be provided. Further, a connector, which can correspond to a power source of a voltage higher than that of the current commercial power source or a direct current power source and safely supply the electric power from the power source can be provided.

Although in the above embodiments, the jack connector 10 is explained as an example of a connector including the switch device 100, the switch device 100 may be incorporated in a plug connector.

Further, the plug connector 300 may be configured to be electrically connected to the power source side and the jack connector may be configured to be electrically connected to the electronic device side.

Although a preferred embodiment of the connector or the switch device has been specifically illustrated and described, it is to be understood that minor modifications may be made therein without departing from the spirit and scope of the invention as defined by the claims.

The present invention is not limited to the specifically disclosed embodiments, and variations and modifications may be made without departing from the scope of the present invention.

The present application is based on Japanese Priority Application No. 2011-176404 filed on Aug. 11, 2011, the entire contents of which are hereby incorporated herein by reference.

What is claimed is:

1. A switch device comprising:

a first contacting portion including a first fixed contacting portion and a first movable contacting portion configured to contact the first fixed contacting portion;

a second contacting portion including a second fixed contacting portion and a second movable contacting portion configured to contact the second fixed contacting portion, and provided to be adjacent to the first contacting portion, the first contacting portion and the second contacting portion being configured to be electrically connected to a power source such that directions of currents flowing between the first fixed contacting portion and the first movable contacting portion, and between the second fixed contacting portion and the second movable contacting portion are the same; and a magnet unit provided such that a first pole is positioned to face a first contacting area of the first fixed contacting portion and the first movable contacting portion, and a second pole, opposite to the first pole, is positioned to face a second contacting area of the second fixed contacting portion and the second movable contacting portion.

2. The switch device according to claim 1, wherein the magnet unit is provided such that an electric arc generated between the first fixed contacting portion and the first movable contacting portion is blown off by the magnet unit in a direction different from the second contacting portion, and an electric arc generated between the second fixed contacting portion and the second movable contacting portion is blown off by the magnet unit in a direction different from the first contacting portion.

3. The switch device according to claim 1, wherein the magnet unit includes a first magnet provided such that the first pole of the first magnet is positioned to face the first contacting area of the first fixed contacting portion and the first movable contacting portion, and a second magnet provided such that the second pole, which is opposite to the first pole, of the second magnet is positioned to face the second contacting area of the second fixed contacting portion and the second movable contacting portion.

4. The switch device according to claim 3, wherein the first magnet and the second magnet are provided such that an electric arc generated between the first fixed contacting portion and the first movable contacting portion is blown off by the first magnet in a direction different from the second contacting portion, and an electric arc generated between the second fixed contacting portion and the second movable contacting portion is blown off by the second magnet in a direction different from the first contacting portion.

5. The switch device according to claim 1, wherein the first contacting portion includes a first fixed spring to which the first fixed contacting portion is connected, a first movable plate portion to which the first movable contacting portion is connected, and a first movable spring to which the first movable plate is connected, the second contacting portion includes a second fixed spring to which the second fixed contacting portion is connected, a second movable plate portion to which the second movable contacting portion is connected, and a second movable spring to which the second movable plate is connected, the first movable plate and the second movable plate being configured to be thicker than the first fixed spring and the second fixed spring, respectively, and the first contacting portion and the second contacting portion are configured to be electrically connected to a power source such that the current flows from the first movable contacting portion to the first fixed contacting portion, and from the second movable contacting portion to the second fixed contacting portion, respectively.

6. The switch device according to claim 1, wherein the first movable contacting portion and the second movable contacting portion are positioned above the first fixed contacting portion and the second fixed contacting portion, respectively, and the first contacting portion and the second contacting portion are configured to be electrically connected to a power source such that the current flows from the first fixed contacting portion to the first movable contacting portion, and from the second fixed contacting portion to the second movable contacting portion, respectively.

7. The switch device according to claim 1, wherein the first fixed contacting portion and the second movable contacting portion are configured to be electrically connected to a power source while the first movable contacting portion and the second fixed contacting portion are configured to be electrically connected to an electronic device.

8. The switch device according to claim 1, wherein the first contacting portion includes a first fixed portion electrically connected to the first fixed contacting portion and supporting the first fixed contacting portion, and a first movable portion electrically connected to the first movable contacting portion and supporting the first movable contacting portion, the second contacting portion includes a second fixed portion electrically connected to the second fixed contacting portion and supporting the second fixed contacting portion, and a second movable portion electrically connected to the second movable contacting portion and supporting the second movable contacting portion, and the switch device further comprising:

a separation cover for separating the first fixed portion and the first movable portion, and the second fixed portion and the second movable portion, provided between the first fixed portion and the first movable portion, and between the second fixed portion and the second movable portion, respectively.

9. The switch device according to claim 8, wherein the separation cover is provided to cover the first fixed portion and the second fixed portion.

10. A connector for electrically connecting a power source and an electronic device, comprising:

a switch device that includes, a first contacting portion including a first fixed contacting portion and a first movable contacting portion configured to contact the first fixed contacting portion, a second contacting portion including a second fixed contacting portion and a second movable contacting portion configured to contact the second fixed contacting portion, and provided to be adjacent to the first contacting portion; and a first fitting terminal and a second fitting terminal configured to be electrically connected to the first fixed contacting portion and the second movable contacting portion, respectively, to be fitted with terminals of another connector which is electrically connected to one of a power source and an electronic device, the second fixed contacting portion and the first movable contacting portion being configured to be electrically connected to the other of the power source and the electronic device.

11. The connector according to claim 10, wherein the switch device further includes, a magnet unit provided such that a first pole is positioned to face a first contacting area of the first fixed contacting portion and the first movable contacting portion, and a second pole, opposite to the first pole, is positioned to face a second contacting area of the second fixed contacting portion and the second movable contacting portion.

* * * * *